US008768543B2

(12) United States Patent
Kumar et al.

(10) Patent No.: US 8,768,543 B2
(45) Date of Patent: Jul. 1, 2014

(54) METHOD, SYSTEM AND COMPUTER SOFTWARE CODE FOR TRIP OPTIMIZATION WITH TRAIN/TRACK DATABASE AUGMENTATION

(75) Inventors: Ajith Kumar, Erie, PA (US); Glenn Robert Shaffer, Erie, PA (US)

(73) Assignee: General Electric Company, Schenectady, NY (US)

( * ) Notice: Subject to any disclaimer, the term of this patent is extended or adjusted under 35 U.S.C. 154(b) by 1048 days.

(21) Appl. No.: 11/622,136

(22) Filed: Jan. 11, 2007

(65) Prior Publication Data

US 2007/0219682 A1 Sep. 20, 2007

Related U.S. Application Data

(63) Continuation-in-part of application No. 11/385,354, filed on Mar. 20, 2006.

(60) Provisional application No. 60/869,196, filed on Dec. 8, 2006.

(51) Int. Cl.
*G05D 1/00* (2006.01)

(52) U.S. Cl.
USPC ..... 701/19; 701/20; 701/22; 701/33.4; 701/408; 701/409

(58) Field of Classification Search
CPC combination set(s) only.
See application file for complete search history.

(56) References Cited

U.S. PATENT DOCUMENTS 2,104,652 A 1/1938 Inman
2,601,634 A 6/1952 Rivette
2,927,711 A 3/1960 Naggiar
3,519,805 A 7/1970 Thorne-Booth
3,650,216 A 3/1972 Harwick et al.

(Continued)

FOREIGN PATENT DOCUMENTS

CA 2 192 151 4/2000
CH 642 418 4/1984

(Continued)

OTHER PUBLICATIONS

Cheng, J.X. et al. "Algorithms on optimal driving strategies for train control problem" 3rd World Congress on Intelligent Control and Automation Jun. 28 to Jul. 2, 2000 pp. 3523-3527.

(Continued)

*Primary Examiner* — Khoi Tran
*Assistant Examiner* — Jonathan L Sample
(74) *Attorney, Agent, or Firm* — GE Global Patent Operation; John A. Kramer

(57) ABSTRACT

A system for providing at least one of train information and track characterization information for use in train performance, including a first element to determine a location of a train on a track segment and/or a time from a beginning of the trip. A track characterization element to provide track segment information, and a sensor for measuring an operating condition of at least one of the locomotives in the train are also included. A database is provided for storing track segment information and/or the operating condition of at least one of the locomotives. A processor is also included to correlate information from the first element, the track characterization element, the sensor, and/or the database, so that the database may be used for creating a trip plan that optimizes train performance in accordance with one or more operational criteria for the train.

13 Claims, 10 Drawing Sheets

(56) References Cited

U.S. PATENT DOCUMENTS 3,655,962 A 4/1972 Koch
3,781,139 A 12/1973 Lohse
3,794,833 A 2/1974 Blazek et al.
3,865,042 A 2/1975 DePaola et al.
3,886,870 A 6/1975 Pelabon
3,948,314 A 4/1976 Creswick et al.
4,005,838 A 2/1977 Grundy
4,041,283 A 8/1977 Mosier
4,042,810 A 8/1977 Mosher
4,136,432 A 1/1979 Melley, Jr.
4,181,943 A 1/1980 Mercer, Sr.
4,241,403 A * 12/1980 Schultz ..... 701/32.5
4,253,399 A 3/1981 Spigarelli
4,279,395 A 7/1981 Boggio et al.
4,344,364 A 8/1982 Nickles et al.
4,401,035 A 8/1983 Spigarelli et al.
4,548,164 A 10/1985 Ylonen et al.
4,561,057 A 12/1985 Haley, Jr. et al.
4,602,335 A 7/1986 Perlmutter
4,617,627 A 10/1986 Yasunobu et al.
4,644,705 A 2/1987 Saccomani et al.
4,663,713 A 5/1987 Cornell et al.
4,711,418 A 12/1987 Aver, Jr. et al.
4,735,385 A 4/1988 Nickles et al.
4,794,548 A 12/1988 Lynch et al.
4,827,438 A 5/1989 Nickles et al.
4,843,575 A 6/1989 Crane
4,853,883 A 8/1989 Nickles et al.
5,109,343 A 4/1992 Budway
5,181,541 A 1/1993 Bodenheimer
5,187,945 A 2/1993 Dixon
5,197,627 A 3/1993 Disabato et al.
5,239,472 A 8/1993 Long et al.
5,240,416 A 8/1993 Bennington
5,253,153 A 10/1993 Mathews et al.
5,316,174 A 5/1994 Schutz
5,363,787 A 11/1994 Konopasek et al.
5,388,034 A 2/1995 Allen et al.
5,398,894 A 3/1995 Pascoe
5,437,422 A 8/1995 Newman
5,440,489 A 8/1995 Newman
5,460,013 A 10/1995 Thomsen
5,487,516 A 1/1996 Murata et al.
5,574,649 A * 11/1996 Levy ..... 701/409
5,623,413 A 4/1997 Matheson et al.
5,642,827 A 7/1997 Madsen
5,651,330 A 7/1997 Jewett
5,676,059 A 10/1997 Alt
5,744,707 A 4/1998 Kull
5,755,349 A 5/1998 Brundle
5,758,299 A 5/1998 Sandborg et al.
5,785,392 A 7/1998 Hart
5,794,172 A * 8/1998 Matheson et al. ..... 701/117
5,803,411 A 9/1998 Ackerman et al.
5,828,979 A * 10/1998 Polivka et al. ..... 701/117
5,913,170 A * 6/1999 Wortham ..... 455/457
5,950,967 A 9/1999 Montgomery
5,957,571 A 9/1999 Koster et al.
5,998,915 A 12/1999 Scholz et al.
6,092,021 A 7/2000 Ehlbeck et al.
6,112,142 A 8/2000 Shockley et al.
6,121,924 A * 9/2000 Meek et al. ..... 342/357.43
6,123,111 A 9/2000 Nathan et al.
6,125,311 A * 9/2000 Lo ..... 701/29
6,129,025 A 10/2000 Minakami et al.
6,135,396 A 10/2000 Whitfield et al.
6,144,901 A * 11/2000 Nickles et al. ..... 701/19
6,154,735 A * 11/2000 Crone ..... 706/45
6,198,993 B1 3/2001 Higashi et al.
6,216,957 B1 4/2001 Turunen, Jr.
6,230,668 B1 5/2001 Marsh et al.
6,243,694 B1 6/2001 Bonissone et al.
6,263,266 B1 7/2001 Hawthorne
6,269,034 B1 7/2001 Shibuya
6,270,040 B1 8/2001 Katzer
6,308,117 B1 10/2001 Ryland et al.
6,325,050 B1 12/2001 Gallagher et al.
6,332,106 B1 12/2001 Hawthorne et al.
6,363,331 B1 3/2002 Kyrtsos
6,380,639 B1 4/2002 Soucy
6,404,129 B1 6/2002 Hendricx et al.
6,434,452 B1 * 8/2002 Gray ..... 701/19
6,459,964 B1 10/2002 Vu et al.
6,480,766 B2 * 11/2002 Hawthorne et al. ..... 701/19
6,484,074 B1 * 11/2002 Hazard et al. ..... 701/19
6,487,488 B1 11/2002 Peterson, Jr. et al.
6,501,393 B1 12/2002 Richards et al.
6,505,103 B1 1/2003 Howell et al.
6,516,727 B2 2/2003 Kraft
6,520,124 B2 2/2003 Bohn, II
6,549,803 B1 4/2003 Raghavan et al.
6,591,758 B2 7/2003 Kumar
6,609,049 B1 8/2003 Kane et al.
6,612,245 B2 9/2003 Kumar et al.
6,612,246 B2 9/2003 Kumar
6,615,118 B2 * 9/2003 Kumar ..... 701/19
6,647,328 B2 11/2003 Walker
6,676,089 B1 1/2004 Katzer
6,691,957 B2 2/2004 Hess, Jr. et al.
6,694,231 B1 2/2004 Rezk
6,698,913 B2 3/2004 Yamamoto
6,702,235 B2 3/2004 Katzer
6,732,023 B2 5/2004 Sugita et al.
6,763,291 B1 7/2004 Houpt et al.
6,789,005 B2 9/2004 Hawthorne
6,804,621 B1 * 10/2004 Pedanckar ..... 702/94
6,810,312 B2 10/2004 Jammu et al.
6,824,110 B2 11/2004 Kane et al.
6,845,953 B2 1/2005 Kane et al.
6,853,888 B2 2/2005 Kane et al.
6,856,865 B2 2/2005 Hawthorne
6,863,246 B2 3/2005 Kane et al.
6,865,454 B2 3/2005 Kane et al.
6,873,888 B2 3/2005 Kumar
6,903,658 B2 6/2005 Kane et al.
6,910,792 B2 6/2005 Takada et al.
6,915,191 B2 7/2005 Kane et al.
6,922,619 B2 7/2005 Baig et al.
6,948,837 B2 9/2005 Suzuki
6,953,272 B2 10/2005 Hayakawa et al.
6,957,131 B2 10/2005 Kane et al.
6,973,947 B2 12/2005 Penaloza et al.
6,978,195 B2 12/2005 Kane et al.
6,980,894 B1 12/2005 Gordon et al.
6,996,461 B2 * 2/2006 Kane et al. ..... 701/19
7,021,588 B2 4/2006 Hess, Jr. et al.
7,021,589 B2 4/2006 Hess, Jr. et al.
7,024,289 B2 4/2006 Kane et al.
7,036,774 B2 5/2006 Kane et al.
7,072,747 B2 7/2006 Armbruster et al.
7,072,757 B2 7/2006 Adams et al.
7,073,753 B2 7/2006 Root et al.
7,079,926 B2 7/2006 Kane et al.
7,092,800 B2 8/2006 Kane et al.
7,092,801 B2 * 8/2006 Kane et al. ..... 701/19
7,092,894 B1 8/2006 Crone
7,096,171 B2 8/2006 Hawthorne et al.
7,127,336 B2 10/2006 Houpt et al.
7,131,403 B1 11/2006 Banga et al.
7,164,975 B2 1/2007 Bidaud
7,200,471 B2 * 4/2007 Kane et al. ..... 701/19
7,222,083 B2 * 5/2007 Matheson et al. ..... 705/7.25
7,302,895 B2 12/2007 Kumar et al.
7,340,328 B2 3/2008 Matheson et al.
7,343,314 B2 * 3/2008 Matheson et al. ..... 701/19
7,347,168 B2 3/2008 Reckels et al.
7,349,797 B2 3/2008 Donnelly et al.
7,386,391 B2 * 6/2008 Morariu et al. ..... 701/117
7,497,201 B2 3/2009 Hollenbeck
7,500,436 B2 3/2009 Kumar et al.
7,509,193 B2 3/2009 Kustosch
7,522,990 B2 4/2009 Daum et al.
7,539,624 B2 5/2009 Matheson et al.
7,558,740 B2 7/2009 Matheson et al.

(56) References Cited

U.S. PATENT DOCUMENTS

| | | | | |
|---|---|---|---|---|
| 7,610,152 | B2 * | 10/2009 | Meyer | 701/408 |
| 7,618,011 | B2 | 11/2009 | Oleski et al. | |
| 7,650,207 | B2 * | 1/2010 | Metzger | 701/19 |
| 7,667,611 | B2 | 2/2010 | Lindsey et al. | |
| 8,082,071 | B2 * | 12/2011 | Daum et al. | 701/19 |
| 8,150,568 | B1 * | 4/2012 | Gray | 701/19 |
| 2001/0029411 | A1 | 10/2001 | Hawthorne | |
| 2001/0047241 | A1 | 11/2001 | Khavakh et al. | |
| 2002/0010531 | A1 * | 1/2002 | Hawthorne et al. | 701/19 |
| 2002/0059075 | A1 | 5/2002 | Schick et al. | |
| 2002/0072833 | A1 | 6/2002 | Gray | |
| 2002/0093201 | A1 | 7/2002 | Soucy | |
| 2002/0096081 | A1 | 7/2002 | Kraft | |
| 2002/0107618 | A1 | 8/2002 | Deguchi et al. | |
| 2002/0174653 | A1 | 11/2002 | Uzkan | |
| 2003/0001050 | A1 | 1/2003 | Katzer | |
| 2003/0034423 | A1 | 2/2003 | Hess et al. | |
| 2003/0076221 | A1 | 4/2003 | Akiyama et al. | |
| 2003/0091017 | A1 | 5/2003 | Davenport et al. | |
| 2003/0104899 | A1 | 6/2003 | Keller | |
| 2003/0105561 | A1 | 6/2003 | Nickles et al. | |
| 2003/0120400 | A1 | 6/2003 | Ahmed Baig et al. | |
| 2003/0183729 | A1 | 10/2003 | Root et al. | |
| 2003/0213875 | A1 | 11/2003 | Hess, Jr. et al. | |
| 2003/0222981 | A1 * | 12/2003 | Kisak et al. | 348/148 |
| 2003/0229446 | A1 * | 12/2003 | Boscamp et al. | 701/213 |
| 2003/0233959 | A1 | 12/2003 | Kumar | |
| 2003/0236598 | A1 | 12/2003 | Villarreal Antelo et al. | |
| 2004/0010432 | A1 | 1/2004 | Matheson et al. | |
| 2004/0034556 | A1 | 2/2004 | Matheson et al. | |
| 2004/0068359 | A1 | 4/2004 | Neiss et al. | |
| 2004/0073361 | A1 * | 4/2004 | Tzamaloukas et al. | 701/210 |
| 2004/0093245 | A1 | 5/2004 | Matheson et al. | |
| 2004/0098142 | A1 | 5/2004 | Warren et al. | |
| 2004/0104312 | A1 | 6/2004 | Hess et al. | |
| 2004/0108814 | A1 | 6/2004 | Tsuda et al. | |
| 2004/0111309 | A1 * | 6/2004 | Matheson et al. | 705/8 |
| 2004/0122569 | A1 * | 6/2004 | Bidaud | 701/19 |
| 2004/0133315 | A1 * | 7/2004 | Kumar et al. | 700/302 |
| 2004/0172175 | A1 | 9/2004 | Julich et al. | |
| 2004/0174121 | A1 | 9/2004 | Tsuda et al. | |
| 2004/0245410 | A1 | 12/2004 | Kisak et al. | |
| 2005/0007020 | A1 | 1/2005 | Tsuda et al. | |
| 2005/0055287 | A1 | 3/2005 | Schmidtberg et al. | |
| 2005/0065674 | A1 | 3/2005 | Houpt et al. | |
| 2005/0065711 | A1 * | 3/2005 | Dahlgren et al. | 701/117 |
| 2005/0085961 | A1 | 4/2005 | Kane et al. | |
| 2005/0099323 | A1 * | 5/2005 | Hirose | 340/995.13 |
| 2005/0109882 | A1 | 5/2005 | Armbruster et al. | |
| 2005/0120904 | A1 | 6/2005 | Kumar et al. | |
| 2005/0121005 | A1 | 6/2005 | Edwards | |
| 2005/0171655 | A1 | 8/2005 | Flynn et al. | |
| 2005/0171657 | A1 | 8/2005 | Kumar | |
| 2005/0188745 | A1 | 9/2005 | Staphanos et al. | |
| 2005/0196737 | A1 | 9/2005 | Mann | |
| 2005/0205719 | A1 * | 9/2005 | Hendrickson et al. | 246/122 R |
| 2006/0253233 | A1 * | 11/2006 | Metzger | 701/19 |
| 2006/0271291 | A1 * | 11/2006 | Meyer | 701/213 |
| 2006/0282199 | A1 * | 12/2006 | Daum et al. | 701/19 |
| 2007/0061053 | A1 | 3/2007 | Zeitzew | |
| 2007/0078026 | A1 | 4/2007 | Holt et al. | |
| 2007/0112475 | A1 | 5/2007 | Koebler et al. | |
| 2007/0219680 | A1 * | 9/2007 | Kumar et al. | 701/19 |
| 2007/0219681 | A1 | 9/2007 | Kumar et al. | |
| 2007/0219682 | A1 * | 9/2007 | Kumar et al. | 701/19 |
| 2007/0219683 | A1 | 9/2007 | Daum et al. | |
| 2007/0233364 | A1 | 10/2007 | Kumar | |
| 2007/0260369 | A1 | 11/2007 | Philp et al. | |
| 2007/0261648 | A1 | 11/2007 | Reckels et al. | |
| 2008/0004721 | A1 | 1/2008 | Huff et al. | |
| 2008/0128563 | A1 | 6/2008 | Kumar et al. | |
| 2008/0147256 | A1 | 6/2008 | Liberatore | |
| 2008/0208393 | A1 | 8/2008 | Schricker | |
| 2009/0063045 | A1 | 3/2009 | Figueroa et al. | |
| 2009/0140574 | A1 | 6/2009 | Gorman et al. | |
| 2009/0177345 | A1 | 7/2009 | Severinsky et al. | |
| 2009/0254239 | A1 | 10/2009 | Daum et al. | |
| 2009/0319092 | A1 | 12/2009 | Piche | |
| 2010/0152998 | A1 | 6/2010 | Schwarzmann | |

FOREIGN PATENT DOCUMENTS

| | | | | |
|---|---|---|---|---|
| DE | 1 605 862 | | 5/1971 | |
| DE | 129 761 | | 2/1978 | |
| DE | 208 324 | | 5/1984 | |
| DE | 255 132 | | 3/1988 | |
| DE | 196 45 426 | | 5/1997 | |
| DE | 197 26 542 | | 11/1998 | |
| DE | 199 35 349 | | 2/2001 | |
| DE | 199 35 352 | | 2/2001 | |
| DE | 199 35 353 | | 2/2001 | |
| DE | 100 45 921 | | 3/2012 | |
| EP | 0 114 633 | | 8/1984 | |
| EP | 0 257 662 | | 3/1988 | |
| EP | 0 341 826 | | 11/1989 | |
| EP | 0 428 113 | | 5/1991 | |
| EP | 0 445 047 | | 9/1991 | |
| EP | 467 377 | | 1/1992 | |
| EP | 0 485 978 | | 5/1992 | |
| EP | 0 539 885 | | 5/1993 | |
| EP | 0 554 983 | | 8/1993 | |
| EP | 0 594 226 | | 4/1994 | |
| EP | 755 840 | | 1/1997 | |
| EP | 0 958 987 | | 11/1999 | |
| EP | 1034984 | A2 * | 9/2000 | B60R 16/02 |
| EP | 1 136 969 | | 9/2001 | |
| EP | 1 253 059 | | 10/2002 | |
| EP | 1 293 948 | | 3/2003 | |
| EP | 1 297 982 | | 4/2003 | |
| EP | 1 466 803 | | 10/2004 | |
| FR | 2 129 215 | | 10/1972 | |
| FR | 2 558 806 | | 8/1985 | |
| FR | 2 767 770 | | 3/1999 | |
| GB | 482 625 | | 1/1938 | |
| GB | 1 321 053 | | 6/1973 | |
| GB | 1 321 054 | | 6/1973 | |
| GB | 2 188 464 | | 9/1987 | |
| JP | 60 028153 | | 2/1985 | |
| JP | 32 13459 | | 9/1991 | |
| JP | 50-32733 | | 2/1993 | |
| JP | 06-108869 | | 4/1994 | |
| JP | 10-505036 | | 5/1998 | |
| JP | 2001-065360 | | 3/2001 | |
| WO | WO 90 03622 | | 4/1990 | |
| WO | WO 95/25053 | | 9/1995 | |
| WO | 9606766 | | 3/1996 | |
| WO | WO 99/14093 | | 3/1999 | |
| WO | WO 03/097424 | | 11/2003 | |
| WO | WO 2004/023517 | | 3/2004 | |
| WO | WO 2004/051699 | | 6/2004 | |
| WO | WO 2004/051700 | | 6/2004 | |
| WO | WO 2004/052755 | | 6/2004 | |
| WO | WO 2004/059446 | | 7/2004 | |
| WO | WO 2005/061300 | | 7/2005 | |
| WO | WO 2007/027130 | | 3/2007 | |
| WO | WO 2007/091270 | | 8/2007 | |

OTHER PUBLICATIONS

Franke, R. et al. "An algorithm for the optimal control of the driving of trains" IEEE Conference on Decision and Control, 2000 Dec. 12-15, 2000 pp. 2123-2127.

* cited by examiner

METHOD, SYSTEM AND COMPUTER SOFTWARE CODE FOR TRIP OPTIMIZATION WITH TRAIN/TRACK DATABASE AUGMENTATION

This application is a Continuation-In-Part of U.S. application Ser. No. 11/385,354, filed Mar. 20, 2006, the contents of which are incorporated herein by reference in its entirety, and is based on Provisional Application No. 60/869,196 filed Dec. 8, 2006.

FIELD OF THE INVENTION

The field of invention relates to a system and method for optimizing train operations, and more particularly to a system and method for augmenting and updating a train/track database associated with the system, method, and/or computer software code for optimizing train operations.

BACKGROUND OF THE INVENTION

A locomotive is a complex system with numerous subsystems, each subsystem interdependent on other subsystems. An operator aboard a locomotive applies tractive and braking effort to control the speed of the locomotive and its load of railcars to assure safe and timely arrival at the desired destination. To perform this function and comply with prescribed operating speeds that may vary with the train's location on the track, the operator generally must have extensive experience operating the locomotive over the specified terrain with various railcar consists, i.e., different types and number of railcars.

However, even with sufficient knowledge and experience to assure safe operation, the operator generally cannot operate the locomotive to minimize fuel consumption (or other operating characteristics, e.g., emissions) during a trip. Multiple operating factors affect fuel consumption, including, for example, emission limits, locomotive fuel/emissions characteristics, size and loading of railcars, weather, traffic conditions and locomotive operating parameters. An operator can more effectively and efficiently operate a train (through the application of tractive and braking efforts) if provided control information that optimizes performance during a trip while meeting a required schedule (arrival time) and using a minimal amount of fuel (or optimizing another operating parameter), despite the many variables that affect performance. Thus it is desired for the operator to operate the train under the guidance (or control) of a system or process that advises the application of tractive and braking efforts to optimize one or more operating parameters.

BRIEF DESCRIPTION OF THE INVENTION

Exemplary embodiments of the invention disclose a system, method, and computer software code for augmenting and updating a train/track database associated with a system, method, and/or computer software code for optimizing train operations. Towards this end, a system for providing train information and/or track characterization information for use in train performance is disclosed. The system includes a first element to determine at least one of a location of a train on a track segment and a time from a beginning of the trip. A track characterization element to provide track segment information is further disclosed. A sensor for measuring an operating condition of at least one of the locomotives in the train, and a database for storing track segment information and/or the operating condition of at least one of the locomotives is further disclosed. A processor is disclosed to correlate information from the first element, the track characterization element, the sensor, and the database, so that the database may be used for creating a trip plan that optimizes train performance in accordance with one or more operational criteria for the train.

In another exemplary embodiment, a system for operating a train during a trip along a track segment, the train comprising one or more locomotive consists with each locomotive consist comprising one or more locomotives is disclosed. The system includes a first element to determine a location of the train on the track segment and/or a time from a beginning of the trip. A track characterization element to provide track segment information, and a sensor for measuring an operating condition of at least one of the locomotives is also disclosed. A database is disclosed for storing track segment information and/or the operating condition of at least one of the locomotives. A processor is also disclosed, which is operable to receive information from the first element, the sensor, the track characterization element, and/or the database for creating a trip plan that optimizes locomotive performance in accordance with one or more operational criteria for the train.

In yet another exemplary embodiment, a method for operating a train during a trip along a track segment, the train comprising one or more locomotive consists with each locomotive consist comprising one or more locomotives is disclosed. The method includes a step for determining a location of the train on a track or a time from a beginning of the trip, and a step for determining track segment information. Two other steps include storing the track segment information, and determining at least one operating condition of at least one of the locomotives. Another step provides for creating a trip plan responsive to at least one of the location of the train, the track segment information, and at least one operating condition to optimize locomotive performance in accordance with one or more operational criteria for the train.

Another exemplary embodiment discloses a computer software code for operating a train having a computer processor, the code for operating the train during a trip along a track segment, the train comprising one or more locomotive consists with each locomotive consist comprising one or more locomotives. The software code includes a software module for determining track segment information, and a software module for storing the track segment information. A software module is also provided for determining at least one operating condition of one of the locomotives. The software code also includes a software module for creating a trip plan responsive to at least one of the location of the train, the track segment information and at least one operating condition to optimize locomotive performance in accordance with one or more operational criteria for the train.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
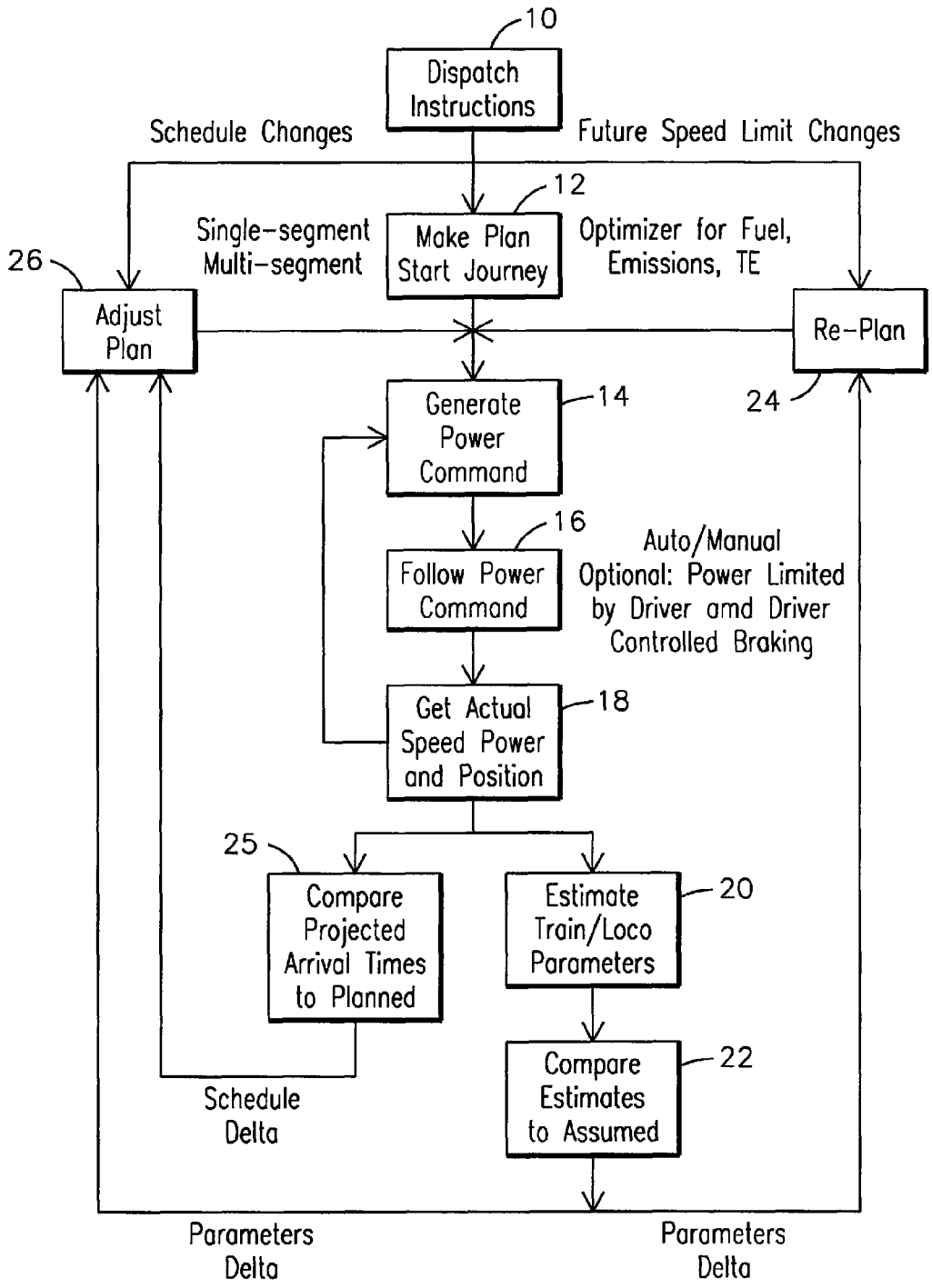
FIG. 1 depicts an exemplary illustration of a flow chart for trip optimization.

Reference will now be made in detail to the embodiments consistent with the invention, examples of which are illustrated in the accompanying drawings. Wherever possible, the same reference numerals used throughout the drawings refer to the same or like parts.

The exemplary embodiment disclosed herein of the present invention solves the problems in the art by providing a system, method, and computer implemented method for determining and implementing an operating strategy for a train having a locomotive consist (i.e., a plurality of directly connected locomotives or one or more locomotive consists distributed within the train) to monitor and control a train's operations to improve certain objective operating criteria parameter requirements while satisfying schedule and speed constraints. Examples of the invention are also applicable to a distributed power train, i.e., a train having one or more locomotive consists spaced apart from the lead locomotive and controllable by the lead locomotive operator.

Persons skilled in the art will recognize that an apparatus, such as a data processing system, including a CPU, memory, I/O, program storage, a connecting bus, and other appropriate components, could be programmed or otherwise designed to facilitate the practice of the method of the invention. Such a system would include appropriate program means for executing the method of the invention.

In another embodiment, an article of manufacture, such as a pre-recorded disk or other similar computer program product, for use with a data processing system, includes a storage medium and a program recorded thereon for directing the data processing system to facilitate the practice of the method of the invention. Such apparatus and articles of manufacture also fall within the spirit and scope of the invention.

Broadly speaking, the technical effect is determining and implementing a driving strategy of a train to improve certain objective operating parameters while satisfying schedule and speed constraints wherein a train/track database is augmented with information about the train (usually the locomotives) and the track. To facilitate an understanding of examples of the present invention, it is described hereinafter with reference to specific implementations thereof.

Exemplary embodiments of the invention are described in the general context of computer-executable instructions, such as program modules, executed by a computer. Generally, program modules include routines, programs, objects, components, data structures, etc. that perform particular tasks or implement particular abstract data types. For example, the software programs that underlie exemplary examples of the invention can be coded in different languages, for use with different processing platforms. In the description that follows, examples of the invention are described in the context of a web portal that employs a web browser. It will be appreciated, however, that the principles that underlie exemplary embodiments of the invention can be implemented with other types of computer software technologies as well.

Moreover, those skilled in the art will appreciate that examples of the invention may be practiced with other computer system configurations, including hand-held devices, multiprocessor systems, microprocessor-based or programmable consumer electronics, minicomputers, mainframe computers, and the like. The exemplary embodiments of the invention may also be practiced in a distributed computing environment where tasks are performed by remote processing devices that are linked through a communications network. In the distributed computing environment, program modules may be located in both local and remote computer storage media including memory storage devices. These local and remote computing environments may be contained entirely within the locomotive, or within adjacent locomotives in consist or off-board in wayside or central offices where wireless communications are provided between the computing environments.

The term locomotive consist means one or more locomotives in succession, connected together so as to provide motoring and/or braking capability with no railcars between the locomotives. A train may comprise one or more locomotive consists. Specifically, there may be a lead consist and one or more remote consists, such as a first remote consist midway along the line of railcars and another remote consist at an end of train position. Each locomotive consist may have a first or lead locomotive and one or more trailing locomotives. Though a first locomotive is usually viewed as the lead locomotive, those skilled in the art will readily recognize that the first locomotive in a multi locomotive consist may be physically located in a physically trailing position. Also, even though a consist is usually considered as connected successive locomotives, those skilled in the art will readily recognize that a group of locomotives may also be recognized as a consist even with at least one railcar separating the locomotives, such as when the consist is configured for distributed power operation, wherein throttle and braking commands are relayed from the lead locomotive to the remote trails by a radio link or physical cable. Towards this end, the term locomotive consist should be not be considered a limiting factor when discussing multiple locomotives within the same train.

Referring now to the drawings, embodiments of the present invention will be described. Exemplary embodiment of the invention can be implemented in numerous ways, including as a system (including a computer processing system), a method (including a computerized method), an apparatus, a computer readable medium, a computer program product, a graphical user interface, including a web portal, or a data structure tangibly fixed in a computer readable memory. Several embodiments of the exemplary examples of the invention are discussed below.

FIG. 1 depicts an illustration of an exemplary flow chart for trip optimization. As illustrated, instructions are input specific to planning a trip either on board or from a remote location, such as a dispatch center 10. Such input information includes, but is not limited to, train position, consist composition (such as locomotive models), locomotive tractive power performance of locomotive traction transmission, consumption of engine fuel as a function of output power, cooling characteristics, intended trip route (effective track grade and curvature as function of milepost or an "effective grade" component to reflect curvature, following standard railroad practices), car makeup and loading (including effective drag coefficients), desired trip parameters including, but not limited to, start time and location, end location, travel time, crew (user and/or operator) identification, crew shift expiration time and trip route.

This data may be provided to the locomotive 42 according to various techniques and processes, such as, but not limited to, manual operator entry into the locomotive 42 via an onboard display, linking to a data storage device such as a hard card, hard drive and/or USB drive or transmitting the information via a wireless communications channel from a central or wayside location 41, such as a track signaling device and/or a wayside device, to the locomotive 42. Locomotive 42 and train 31 load characteristics (e.g., drag) may also change over the route (e.g., with altitude, ambient temperature and condition of the rails and rail-cars), causing a plan update to reflect such changes according to any of the methods discussed above. The updated data that affects the trip optimization process can be supplied by any of the methods and techniques described above and/or by real-time autonomous collection of locomotive/train conditions. Such updates include, for example, changes in locomotive or train characteristics detected by monitoring equipment on or off board the locomotive(s) 42.

A track signal system indicates certain track conditions and provides instructions to the operator of a train approaching the signal. The signaling system, which is described in greater detail below, indicates, for example, an allowable train speed over a segment of track and provides stop and run instructions to the train operator. Details of the signal system, including the location of the signals and the rules associated with different signals are stored in the onboard database 63.

Based on the specification data input into the present the exemplary embodiment of the invention, an optimal trip plan that minimizes fuel use and/or generated emissions subject to speed limit constraints and a desired start and end time is computed to produce a trip profile 12. The profile contains the optimal speed and power (notch) settings for the train to follow, expressed as a function of distance and/or time from the beginning of the trip, train operating limits, including but not limited to, the maximum notch power and brake settings, speed limits as a function of location and the expected fuel used and emissions generated. In an exemplary embodiment, the value for the notch setting is selected to obtain throttle change decisions about once every 10 to 30 seconds.

Those skilled in the art will readily recognize that the throttle change decisions may occur at longer or shorter intervals, if needed and/or desired to follow an optimal speed profile. In a broader sense, it should be evident to ones skilled in the art that the profiles provide power settings for the train, either at the train level, consist level and/or individual locomotive level. As used herein, power comprises braking power, motoring power and airbrake power. In another preferred embodiment, instead of operating at the traditional discrete notch power settings, the example of the present invention determines a desired power setting, from a continuous range of power settings, to optimize the speed profile. Thus, for example, if an optimal profile specifies a notch setting of 6.8, instead of a notch setting of 7, the locomotive 42 operates at 6.8. Allowing such intermediate power settings may provide additional efficiency benefits as described below.

The procedure for computing the optimal profile can include any number of methods for computing a power sequence that drives the train 31 to minimize fuel and/or emissions subject to locomotive operating and schedule constraints, as summarized below. In some situations the optimal profile may be sufficiently similar to a previously determined profile due to the similarity of train configurations, route and environmental conditions. In these cases it may be sufficient to retrieve the previously-determined driving trajectory from the database 63 and operate the train accordingly.

When a previous plan is not available, methods to compute a new plan include, but are not limited to, direct calculation of the optimal profile using differential equation models that approximate train physics of motion. According to this process, a quantitative objective function is determined; commonly the function comprises a weighted sum (integral) of model variables that correspond to a fuel consumption rate and emissions generated plus a term to penalize excessive throttle variations.

An optimal control formulation is established to minimize the quantitative objective function subject to constraints including but not limited to, speed limits, minimum and maximum power (throttle) settings, and maximum cumulative and instantaneous emissions. Depending on planning objectives at any time, the problem may be setup to minimize fuel subject to constraints on emissions and speed limits or to minimize emissions subject to constraints on fuel use and arrival time. It is also possible to setup, for example, a goal to minimize the total travel time without constraints on total emissions or fuel use where such relaxation of constraints is permitted or required for the mission.

Throughout the document exemplary equations and objective functions are presented for minimizing locomotive fuel consumption. These equations and functions are for illustration only as other equations and objective functions can be employed to optimize fuel consumption or to optimize other locomotive/train operating parameters.

Mathematically, the problem to be solved may be stated more precisely. The basic physics are expressed by:

$$\frac{dx}{dt} = v;\ x(0) = 0.0;\ x(T_f) = D$$

$$\frac{dv}{dt} = T_e(u, v) - G_a(x) - R(v);\ v(0) = 0.0;\ v(T_f) = 0.0$$

where x is the position of the train, v is train velocity, t is time (in miles, miles per hour and minutes or hours as appropriate) and u is the notch (throttle) command input. Further, D denotes the distance to be traveled, $T_f$ the desired arrival time at distance D along the track, $T_e$ is the tractive effort produced by the locomotive consist, $G_a$ is the gravitational drag (which depends on train length, train makeup and travel terrain) and R is the net speed dependent drag of the locomotive consist and train combination. The initial and final speeds can also be specified, but without loss of generality are taken to be zero here (train stopped at beginning and end of the trip).

The model is readily modified to include other dynamics factors such the lag between a change in throttle u and a resulting tractive or braking effort.

All these performance measures can be expressed as a linear combination of any of the following:

$$\min_{u(t)} \int_0^{T_f} F(u(t))dt - \text{Minimize total fuel consumption}$$

$$\min_{u(t)} T_f - \text{Minimize Travel Time}$$

-continued $$\min_{u_i} \sum_{i=2}^{n_d} (u_i - u_{i-d})^2 - \text{Minimize notch jockeying (piecewise constant input)}$$

$$\min_{u(t)} \int_0^{T_f} \left(\frac{du}{dt}\right)^2 dt - \text{Minimize notch jockeying (continuous input)}$$

Replace the fuel term F(•) in (1) with a term corresponding to emissions production. For example for emissions $$\min_{u(t)} \int_0^{T_f} E(u(t))dt - \text{Minimize total emissions consumption.}$$

In this equation E is the quantity of emissions in grams per horse power-hour (gm/hphr) for each of the notches (or power settings). In addition a minimization could be done based on a weighted total of fuel and emissions.

A commonly used and representative objective function is thus $$\min_{u(t)} \alpha_1 \int_0^{T_f} F(u(t))dt + \alpha_3 T_f + \alpha_2 \int_0^{T_f} \left(\frac{du}{dt}\right)^2 dt \quad \text{(OP)}$$

The coefficients of the linear combination depend on the importance (weight) given to each of the terms. Note that in equation (OP), u(t) is the optimizing variable that is the continuous notch position. If discrete notch is required, e.g. for older locomotives, the solution to equation (OP) is discretized, which may result in lower fuel savings. Finding a minimum time solution ($\alpha_1$ set to zero and $\alpha_2$ set to zero or a relatively small value) is used to find a lower bound for the achievable travel time ($T_f = T_{fmin}$). In this case, both u(t) and $T_f$ are optimizing variables. The preferred embodiment solves the equation (OP) for various values of $T_f$ with $T_f > T_{fmin}$ with $\alpha_3$ set to zero. In this latter case, $T_f$ is treated as a constraint.

For those familiar with solutions to such optimal problems, it may be necessary to adjoin constraints, e.g. the speed limits along the path:

$$0 \le v \le SL(x)$$

or when using minimum time as the objective, the adjoin constraint may be that an end point constraint must hold, e.g. total fuel consumed must be less than what is in the tank, e.g. via:

$$0 < \int_0^{T_f} F(u(t))dt \le W_F$$

where $W_F$ is the fuel remaining in the tank at $T_f$. Those skilled in the art will readily recognize that equation (OP) can presented in other forms and that the version above is an exemplary equation for use in the example of the present invention.

Reference to emissions in the context of the present invention is generally directed to cumulative emissions produced in the form of oxides of nitrogen ($NO_x$), carbon oxide ($CO_x$), hydrocarbons (HC) and particulate matter (PM). Other emissions may include, but not be limited to a maximum value of electromagnetic emission, such as a limit on radio frequency (RF) power output, measured in watts, for respective frequencies emitted by the locomotive. Yet another form of emission is the noise produced by the locomotive, typically measured in decibels (dB). An emission requirement may be variable based on a time of day, a time of year, and/or atmospheric conditions such as weather or pollutant level in the atmosphere. Emission regulations may vary geographically across a railroad system. For example, an operating area such as a city or state may have specified emission objectives, and an adjacent area may have different emission objectives, for example a lower amount of allowed emissions or a higher fee charged for a given level of emissions.

Accordingly, an emission profile for a certain geographic area may be tailored to include maximum emission values for each of the regulated emissions including in the profile to meet a predetermined emission objective required for that area. Typically, for a locomotive, these emission parameters are determined by, but not limited to, the power (Notch) setting, ambient conditions, engine control method, etc. By design, every locomotive must be compliant with EPA emission standards, and thus in an embodiment of the present invention that optimizes emissions this may refer to mission-total emissions, for which there is no current EPA specification. Operation of the locomotive according to the optimized trip plan is at all times compliant with EPA emission standards.

If a key objective during a trip is to reduce emissions, the optimal control formulation, equation (OP), is amended to consider this trip objective. A key flexibility in the optimization process is that any or all of the trip objectives can vary by geographic region or mission. For example, for a high priority train, minimum time may be the only objective on one route because of the train's priority. In another example emission output could vary from state to state along the planned train route.

To solve the resulting optimization problem, in an exemplary embodiment the present invention transcribes a dynamic optimal control problem in the time domain to an equivalent static mathematical programming problem with N decision variables, where the number 'N' depends on the frequency at which throttle and braking adjustments are made and the duration of the trip. For typical problems, this N can be in the thousands. In an exemplary embodiment a train is traveling a 172-mile stretch of track in the southwest United States. Utilizing an example of the present invention, a 7.6% fuel consumption may be realized when comparing a trip determined and followed using an exemplary example of the present invention versus a trip where the throttle/speed is determined by the operator according to standard practices. The improved savings is realized because the optimization provided by an example of the present invention produces a driving strategy with both less drag loss and little or no braking loss compared to the operator controlled trip.

Figure 2:
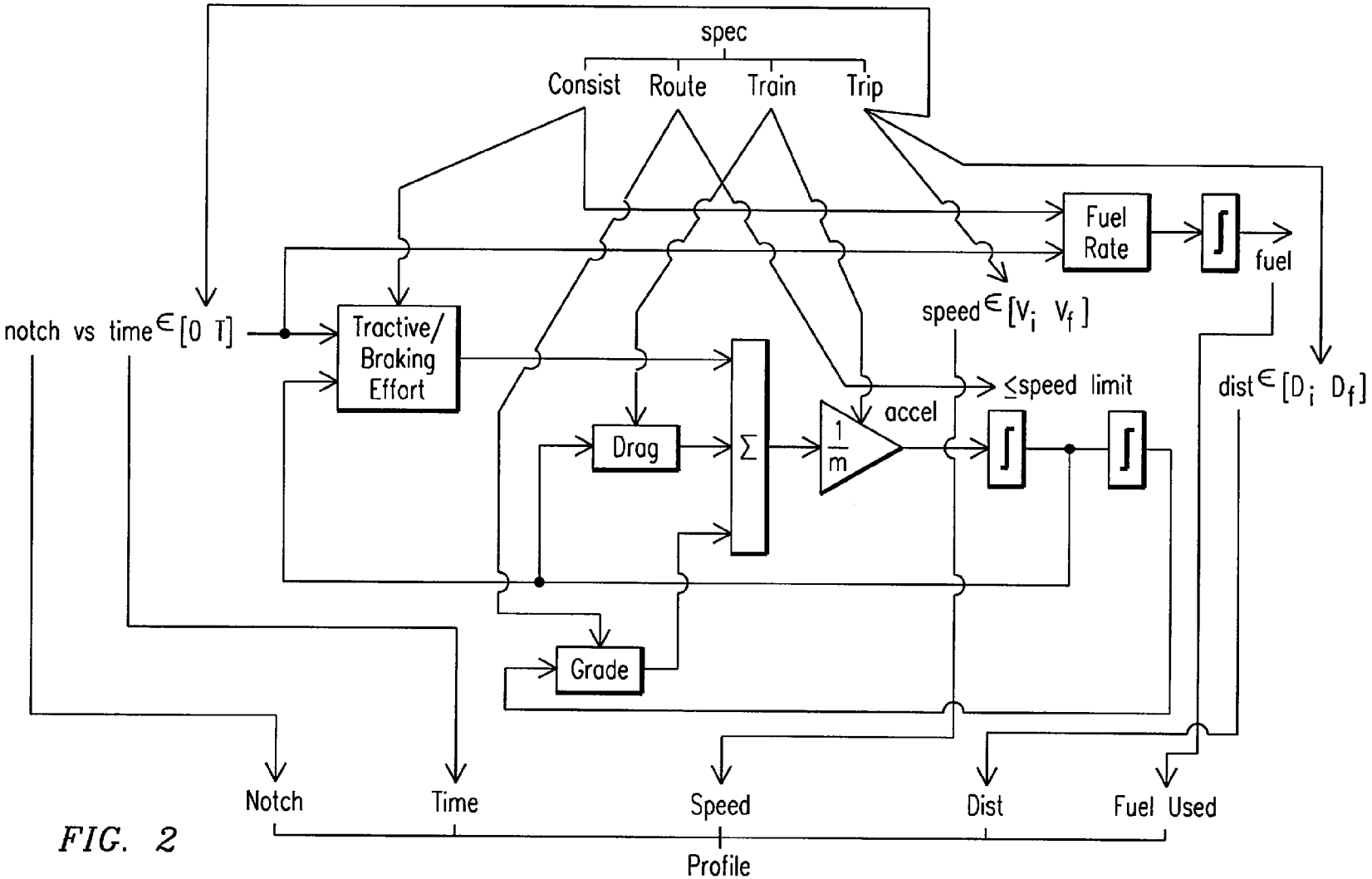
FIG. 2 depicts a simplified model of a train that may be employed.

To make the optimization described above computationally tractable, a. simplified model of the train may be employed, such as illustrated in FIG. 2 and set forth in the equations discussed above. A key refinement to the optimal profile is produced by deriving a more detailed model with the optimal power sequence generated, to test if any thermal, electrical and mechanical constraints are violated, leading to a modified profile with speed versus distance that is closest to a run that can be achieved without damaging the locomotive or train equipment, i.e. satisfying additional implied constraints such thermal and electrical limits on the locomotive and in-train forces.

Referring back to FIG. 1, once the trip is started 12, power commands are generated 14 to put the start the plan. Depending on the operational set-up of the example of the present invention, one command causes the locomotive to follow the optimized power command 16 so as to achieve optimal speed. An example of the present invention obtains actual speed and power information from the locomotive consist of the train 18. Due to the common approximations in the models used for the optimization, a closed-loop calculation of corrections to the optimized power is obtained to track the desired optimal speed. Such corrections of train operating limits can be made automatically or by the operator, who always has ultimate control of the train.

In some cases, the model used in the optimization may differ significantly from the actual train. This can occur for many reasons, including but not limited to, extra cargo pick-ups or setouts, locomotives that fail in-route, errors in the initial database 63 and data entry errors by the operator. For these reasons a monitoring system uses real-time train data to estimate locomotive and/or train parameters in real time 20. The estimated parameters are then compared to the assumed parameters when the trip was initially created 22. Based on any differences in the assumed and estimated values, the trip may be re-planned 24. Typically the trip is re-planned if significant savings can be realized from a new plan.

Other reasons a trip may be re-planned include directives from a remote location, such as dispatch, and/or an operator request of a change in objectives to be consistent with global movement planning objectives. Such global movement planning objectives may include, but are not limited to, other train schedules, time required to dissipate exhaust from a tunnel, maintenance operations, etc. Another reason may be due to an onboard failure of a component. Strategies for re-planning may be grouped into incremental and major adjustments depending on the severity of the disruption, as discussed in more detail below. In general, a "new" plan must be derived from a solution to the optimization problem equation (OP) described above, but frequently faster approximate solutions can be found, as described herein.

Figure 4:
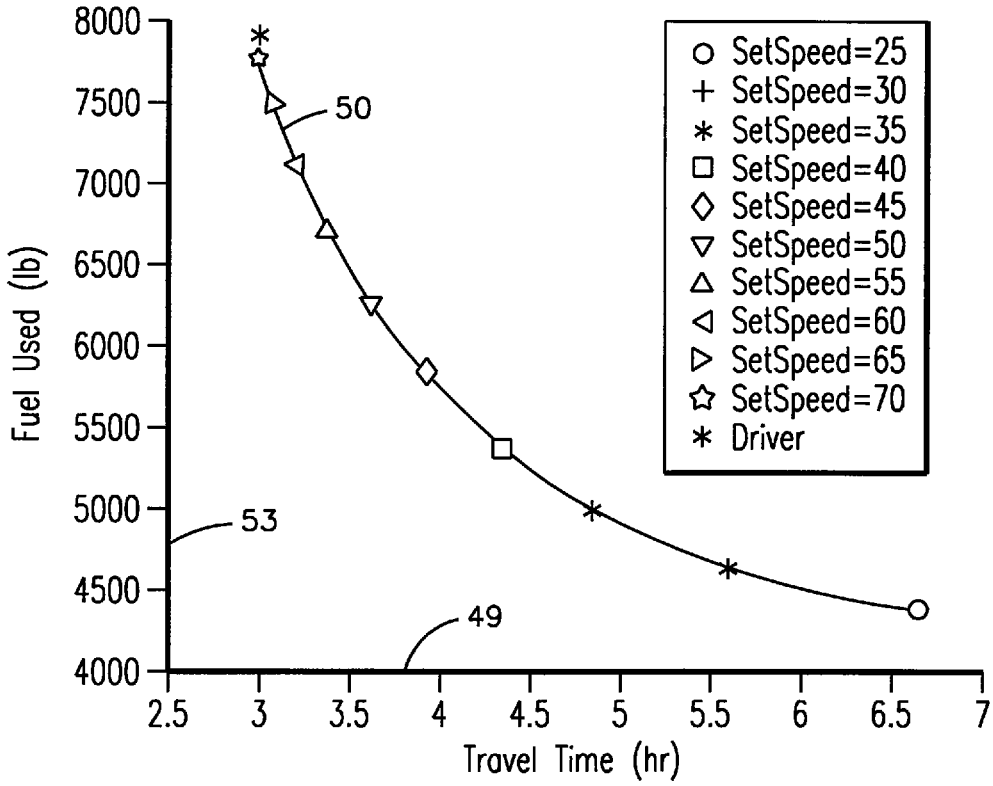
FIG. 4 depicts an exemplary embodiment of a fuel-use/travel time curve.

In operation, the locomotive 42 will continuously monitor system efficiency and continuously update the trip plan based on the actual measured efficiency whenever such an update may improve trip performance. Re-planning computations may be carried out entirely within the locomotive(s) or fully or partially performed at a remote location, such as dispatch or wayside processing facilities where wireless technology can communicate the new plan to the locomotive 42. An example of the present invention may also generate efficiency trends for developing locomotive fleet data regarding efficiency transfer functions. The fleet-wide data may be used when determining the initial trip plan, and may be used for network-wide optimization tradeoff when considering locations of a plurality of trains. For example, the travel-time fuel-use tradeoff curve as illustrated in FIG. 4 reflects a capability of a train on a particular route at a current time, updated from ensemble averages collected for many similar trains on the same route. Thus, a central dispatch facility collecting curves like FIG. 4 from many locomotives could use that information to better coordinate overall train movements to achieve a system-wide advantage in fuel use or throughput.

Many events during daily operations may motivate the generation of a new or modified plan, including a new or modified trip plan that retains the same trip objectives, for example, when a train is not on schedule for a planned meet or pass with another train and therefore must make up the lost time. Using the actual speed, power and location of the locomotive, a planned arrival time is compared with a currently estimated (predicted) arrival time 25. Based on a difference in the times, as well as the difference in parameters (detected or changed by dispatch or the operator) the plan is adjusted 26. This adjustment may be made automatically responsive to a railroad company's policy for handling departures from plan or manually as the on-board operator and dispatcher jointly decide the best approach for returning the plan. Whenever a plan is updated but where the original objectives, such as but not limited to arrival time remain the same, additional changes may be factored in concurrently, e.g. new future speed limit changes, which could affect the feasibility of recovering the original plan. In such instances if the original trip plan cannot be maintained, or in other words the train is unable to meet the original trip plan objectives, as discussed herein other trip plan(s) may be presented to the operator, remote facility and/or dispatch.

A re-plan may also be made when it is desired to change the original objectives. Such re-planning can be done at either fixed preplanned times, manually at the discretion of the operator or dispatcher or autonomously when predefined limits, such a train operating limits, are exceeded. For example, if the current plan execution is running late by more than a specified threshold, such as thirty minutes, an example of the present invention can re-plan the trip to accommodate the delay at the expense of increased fuel consumption as described above or to alert the operator and dispatcher as to the extent to which lost time can be regained, if at all, (i.e. what is the minimum time remaining or the maximum fuel that can be saved within a time constraint). Other triggers for re-plan can also be envisioned based on fuel consumed or the health of the power consist, including but not limited time of arrival, loss of horsepower due to equipment failure and/or equipment temporary malfunction (such as operating too hot or too cold), and/or detection of gross setup errors, such in the assumed train load. That is, if the change reflects impairment in the locomotive performance for the current trip, these may be factored into the models and/or equations used in the optimization process.

Changes in plan objectives can also arise from a need to coordinate events where the plan for one train compromises the ability of another train to meet objectives and arbitration at a different level, e.g. the dispatch office, is required. For example, the coordination of meets and passes may be further optimized through train-to-train communications. Thus, as an example, if an operator knows he is behind schedule in reaching a location for a meet and/or pass, communications from the other train can advise the operator of the late train (and/or dispatch). The operator can enter information pertaining to the expected late arrival into an example of the present invention for recalculating the train's trip plan. An example of the present invention can also be used at a high level or network-level, to allow a dispatch to determine which train should slow down or speed up should it appear that a scheduled meet and/or pass time constraint may not be met. As discussed herein, this is accomplished by trains transmitting data to dispatch to prioritize how each train should change its planning objective. A choice can be made either based on schedule or fuel saving benefits, depending on the situation.

For any of the manually or automatically initiated re-plans, an example of the present invention may present more than one trip plan to the operator. In an exemplary embodiment the present invention presents different profiles to the operator, allowing the operator to select the arrival time and also understand the corresponding fuel and/or emission impact. Such information can also be provided to the dispatch for similar considerations, either as a simple list of alternatives or as a plurality of tradeoff curves such as illustrated in FIG. 4.

In one embodiment the present invention includes the ability to learn and adapt to key changes in the train and power consist that can be incorporated either in the current plan and/or for future plans. For example, one of the triggers discussed above is loss of horsepower. When building up horsepower over time, either after a loss of horsepower or when beginning a trip, transition logic is utilized to determine when a desired horsepower is achieved. This information can be saved in the locomotive database 61 for use in optimizing either future trips or the current trip should loss of horsepower occur again later.

Figure 3:
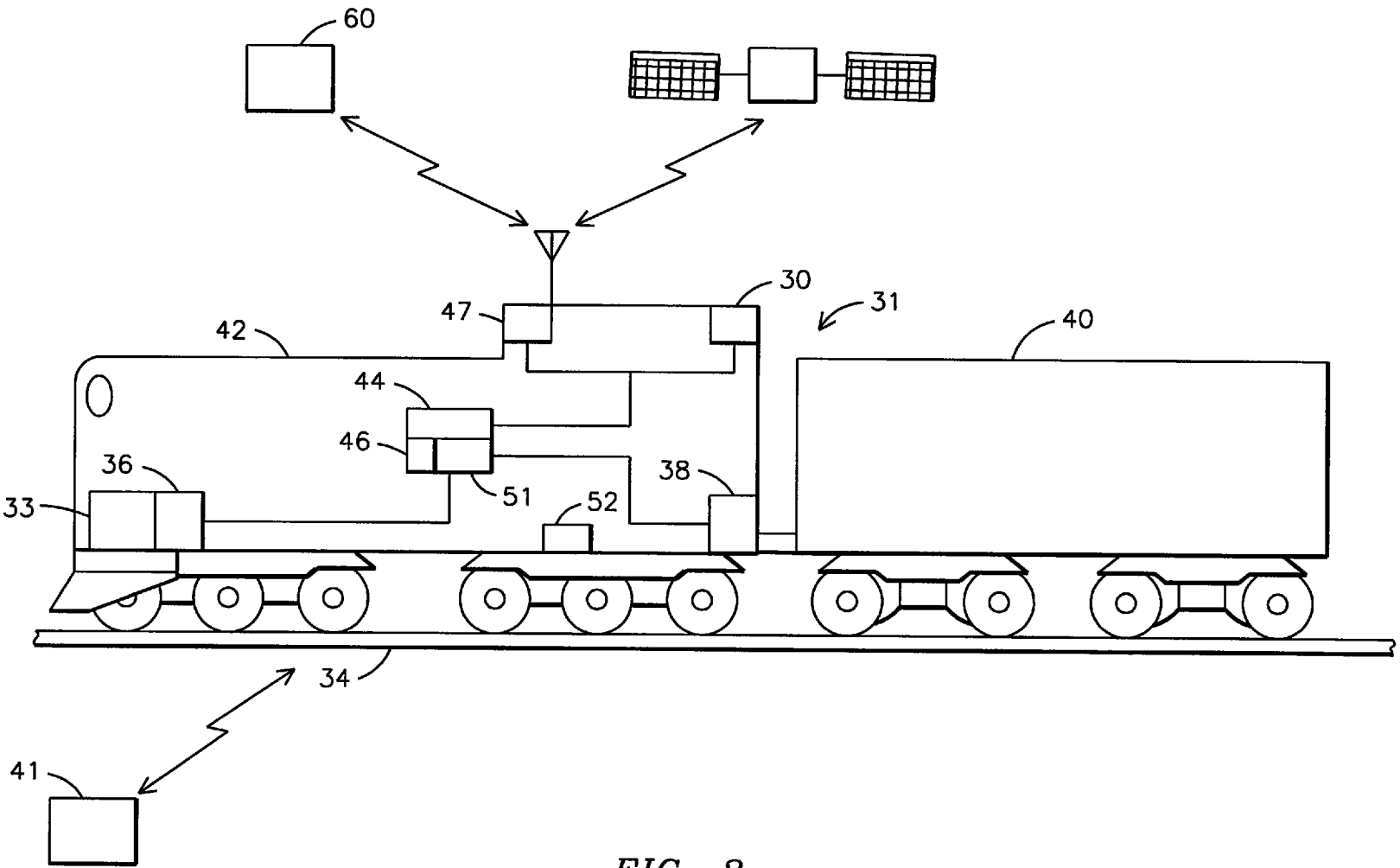
FIG. 3 depicts an exemplary embodiment of elements of a trip optimization system.

FIG. 3 depicts an exemplary embodiment of elements of the trip optimizer. A locator element 30 determines a location of the train 31. The locator element 30 comprises a GPS sensor or a system of sensors that determine a location of the train 31. Examples of such other systems may include, but are not limited to, wayside devices, such as radio frequency automatic equipment identification (RF AEI) tags, dispatch, and/or video-based determinations. Another system may use tachometer(s) aboard a locomotive and distance calculations from a reference point. As discussed previously, a wireless communication system 47 may also be provided to allow communications between trains and/or with a remote location, such as dispatch. Information about travel locations may also be transferred from other trains over the communications system.

A track characterization element 33 provides information about a track, principally grade, elevation and curvature information. The track characterization element 33 may include an on-board track integrity database 36. Sensors 38 measure a tractive effort 40 applied by the locomotive consist 42, throttle setting of the locomotive consist 42, locomotive consist 42 configuration information, speed of the locomotive consist 42, individual locomotive configuration information, individual locomotive capability, etc. In an exemplary embodiment the locomotive consist 42 configuration information may be loaded without the use of a sensor 38, but is input by other approaches as discussed above. Furthermore, the health of the locomotives in the consist may also be considered. For example, if one locomotive in the consist is unable to operate above power notch level 5 this information is used when optimizing the trip plan.

Information from the locator element may also be used to determine an appropriate arrival time of the train 31. For example, if there is a train 31 moving along a track 34 toward a destination and no train is following behind it, and the train has no fixed arrival deadline to satisfy, the locator element, including but not limited to radio frequency automatic equipment identification (RF AEI) tags, dispatch, and/or video-based determinations, may be used to determine the exact location of the train 31. Furthermore, inputs from these signaling systems may be used to adjust the train speed. Using the on-board track database, discussed below, and the locator element, such as GPS, an example of the present invention can adjust the operator interface to reflect the signaling system state at the given locomotive location. In a situation where signal states indicate restrictive speeds ahead, the planner may elect to slow the train to conserve fuel consumption.

Information from the locator element 30 may also be used to change planning objectives as a function of distance to a destination. For example, owing to inevitable uncertainties about congestion along the route, "faster" time objectives on the early part of a route may be employed as hedge against delays that statistically occur later. If on a particular trip such delays do not occur, the objectives on a latter part of the journey can be modified to exploit the built-in slack time that was banked earlier and thereby recover some fuel efficiency. A similar strategy can be invoked with respect to emission-restrictive objectives, e.g. emissions constraints that apply when approaching an urban area.

As an example of the hedging strategy, if a trip is planned from New York to Chicago, the system may provide an option to operate the train slower at either the beginning of the trip, at the middle of the trip or at the end of the trip. An example of the present invention optimizes the trip plan to allow for slower operation at the end of the trip since unknown constraints, such as but not limited to weather conditions, track maintenance, etc., may develop and become known during the trip. As another consideration, if traditionally congested areas are known, the plan is developed with an option to increase the driving flexibility around such regions. Therefore, an example of the present invention may also consider weighting/penalizing as a function of time/distance into the future and/or based on known/past experiences. Those skilled in the art will readily recognize that such planning and re-planning to take into consideration weather conditions, track conditions, other trains on the track, etc., may be considered at any time during the trip wherein the trip plan is adjusted accordingly.

FIG. 3 further discloses other elements that may be part of an example of the present invention. A processor 44 operates to receive information from the locator element 30, track characterizing element 33 and sensors 38. An algorithm 46 operates within the processor 44. The algorithm 46 computes an optimized trip plan based on parameters involving the locomotive 42, train 31, track 34, and objectives of the mission as described herein. In an exemplary embodiment the trip plan is established based on models for train behavior as the train 31 moves along the track 34 as a solution of non-linear differential equations derived from applicable physics with simplifying assumptions that are provided in the algorithm. The algorithm 46 has access to the information from the locator element 30, track characterizing element 33 and/or sensors 38 to create a trip plan minimizing fuel consumption of a locomotive consist 42, minimizing emissions of a locomotive consist 42, establishing a desired trip time, and/or ensuring proper crew operating time aboard the locomotive consist 42. In an exemplary embodiment, a driver or controller element, 51 is also provided. As discussed herein the controller element 51 may control the train as it follows the trip plan. In an exemplary embodiment discussed further herein, the controller element 51 makes train operating decisions autonomously. In another exemplary embodiment the operator may be involved with directing the train to follow or deviate from the trip plan in his discretion.

In one embodiment of the present invention the trip plan is modifiable in real time as the plan is being executed. This includes creating the initial plan for a long distance trip, owing to the complexity of the plan optimization algorithm. When a total length of a trip profile exceeds a given distance, an algorithm 46 may be used to segment the mission by dividing the mission into waypoints. Though only a single algorithm 46 is discussed, those skilled in the art will readily recognize that more than one algorithm may be used and that such multiple algorithms are linked to create the trip plan.

The trip waypoints may include natural locations where the train 31 stops, such as, but not limited to, single mainline sidings for a meet with opposing traffic or for a pass with a train behind the current train, a yard siding, an industrial spur where cars are picked up and set out and locations of planned maintenance work. At such waypoints the train 31 may be required to be at the location at a scheduled time, stopped or moving with speed in a specified range. The time duration from arrival to departure at waypoints is called dwell time.

In an exemplary embodiment, the present invention is able to break down a longer trip into smaller segments according to a systematic process. Each segment can be somewhat arbitrary in length, but is typically picked at a natural location such as a stop or significant speed restriction, or at key waypoints or mileposts that define junctions with other routes. Given a partition or segment selected in this way, a driving profile is created for each segment of track as a function of travel time taken as an independent variable, such as shown in FIG. 4, discussed in more detail below. The fuel used/travel-time tradeoff associated with each segment can be computed prior to the train 31 reaching that segment of track. A total trip plan can therefore be created from the driving profiles created for each segment. An example of the invention optimally distributes travel time among all segments of the trip so that the total trip time required is satisfied and total fuel consumed over all the segments is minimized. An exemplary three segment trip is disclosed in FIG. 6 and discussed below. Those skilled in the art will recognize however, though segments are discussed, the trip plan may comprise a single segment representing the complete trip.

FIG. 4 depicts an exemplary embodiment of a fuel-use/travel time curve. As mentioned previously, such a curve 50 is created when calculating an optimal trip profile for various travel times for each segment. That is, for a given travel time 51, fuel used 52 is the result of a detailed driving profile computed as described above. Once travel times for each segment are allocated, a power/speed plan is determined for each segment from the previously computed solutions. If there are any waypoint speed constraints between the segments, such as, but not limited to, a change in a speed limit, they are matched during creation of the optimal trip profile. If speed restrictions change only within a single segment, the fuel use/travel-time curve 50 has to be re-computed for only the segment changed. This process reduces the time required for re-calculating more parts, or segments, of the trip. If the locomotive consist or train changes significantly along the route, e.g. loss of a locomotive or pickup or set-out of railcars, then driving profiles for all subsequent segments must be recomputed creating new instances of the curve 50. These new curves 50 are then used along with new schedule objectives to plan the remaining trip.

Once a trip plan is created as discussed above, a trajectory of speed and power versus distance allows the train to reach a destination with minimum fuel and/or emissions at the required trip time. There are several techniques for executing the trip plan. As provided below in more detail, in one exemplary embodiment of a coaching mode, an example of the present invention displays control information to the operator. The operator follows the information to achieve the required power and speed as determined according to the optimal trip plan. Thus in this mode the operator is provided with operating suggestions for use in driving the train. In another exemplary embodiment, control actions to accelerate the train or maintain a constant speed are performed by examples of the present invention. However, when the train 31 must be slowed, the operator is responsible for applying brakes by controlling a braking system 52. In another exemplary embodiment, the present invention commands power and braking actions as required to follow the desired speed-distance path.

Feedback control strategies are used to correct the power control sequence in the profile to account for such events as, but not limited to, train load variations caused by fluctuating head winds and/or tail winds. Another such error may be caused by an error in train parameters, such as, but not limited to, train mass and/or drag, as compared with assumptions in the optimized trip plan. A third type of error may occur due to incorrect information in the track database 36. Another possible error may involve un-modeled performance differences due to the locomotive engine, traction motor thermal deration and/or other factors. Feedback control strategies compare the actual speed as a function of position with the speed in the desired optimal profile. Based on this difference, a correction to the optimal power profile is added to drive the actual velocity toward the optimal profile. To assure stable regulation, a compensation algorithm may be provided that filters the feedback speeds into power corrections to assure closed-loop performance stability. Compensation may include standard dynamic compensation as used by those skilled in the art of control system design to meet performance objectives.

Examples of the present invention allow the simplest and therefore fastest means to accommodate changes in trip objectives, which is the rule rather than the exception in railroad operations. In an exemplary embodiment, to determine the fuel-optimal trip from point A to point B where there are stops along the way, and for updating the trip for the remainder of the trip once the trip has begun, a suboptimal decomposition method can be used for finding an optimal trip profile. Using modeling methods, the computation method can find the trip plan with specified travel time and initial and final speeds to satisfy all the speed limits and locomotive capability constraints when there are stops. Though the following discussion is directed to optimizing fuel use, it can also be applied to optimize other factors, such as, but not limited to, emissions, schedule, crew comfort and load impact. The method may be used at the outset in developing a trip plan, and more importantly to adapting to changes in objectives after initiating a trip.

Figure 5:
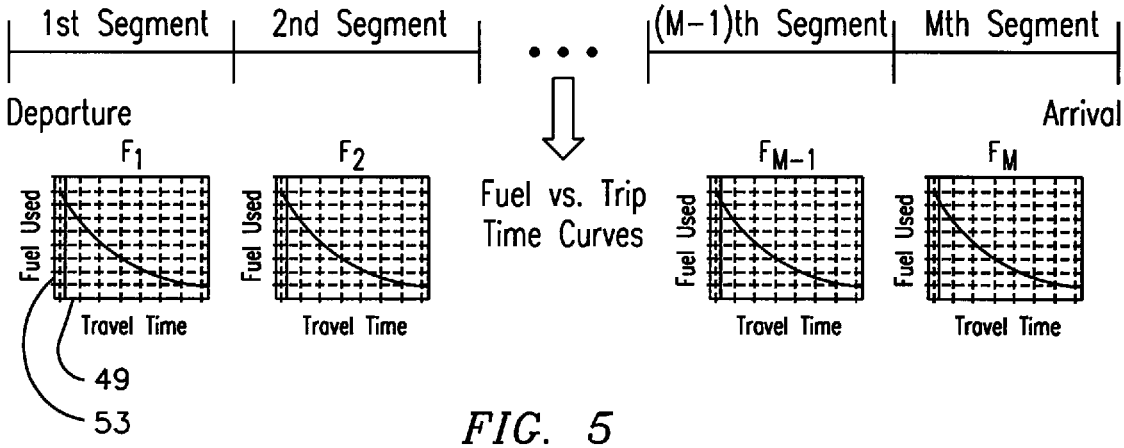
FIG. 5 depicts an exemplary embodiment of segmentation decomposition for trip planning.
Figure 6:
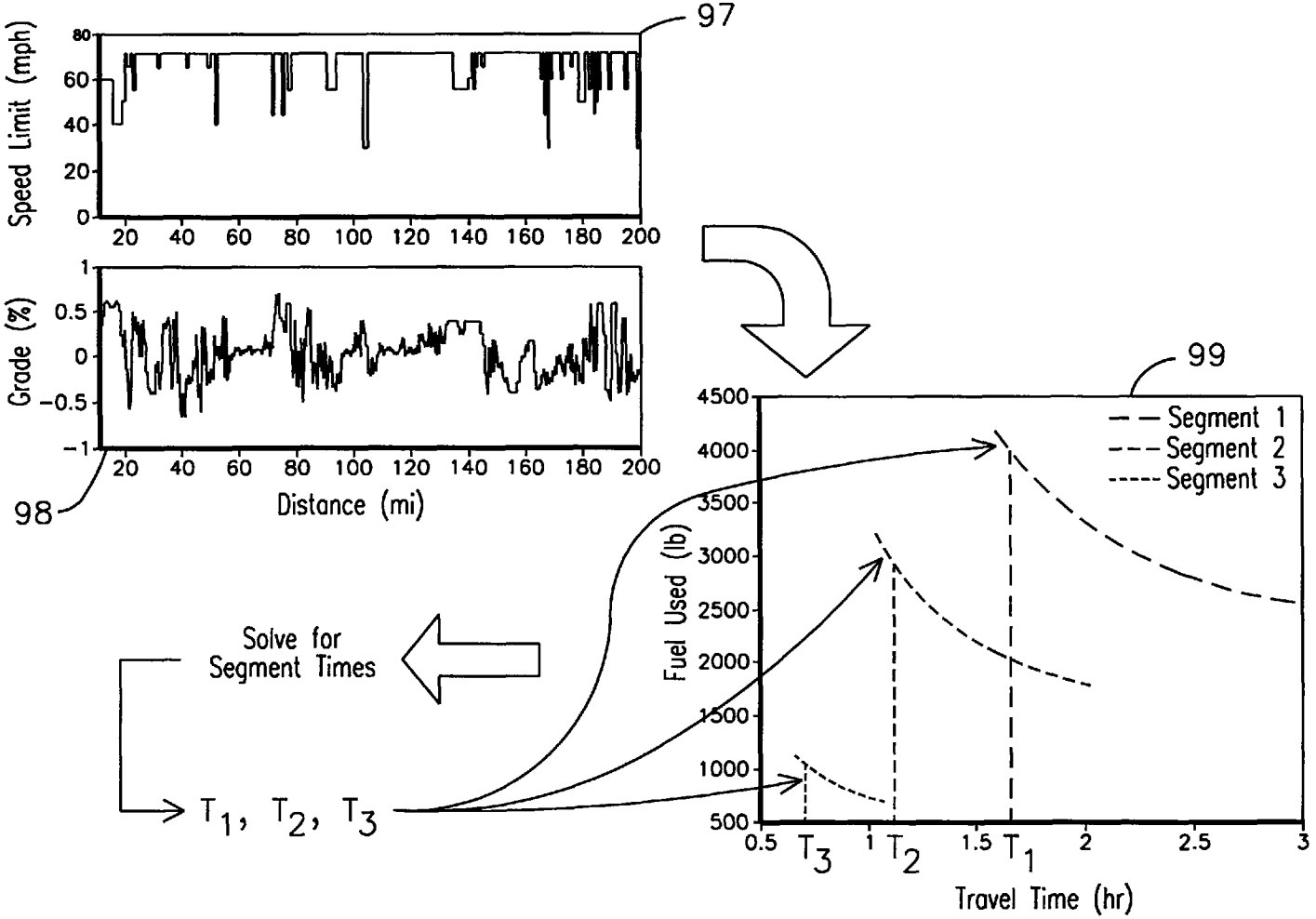
FIG. 6 depicts an exemplary embodiment of a segmentation example.

As discussed herein, examples of the present invention may employ a setup as illustrated in the exemplary flow chart depicted in FIG. 5 and as an exemplary three segment example depicted in detail in FIG. 6. As illustrated, the trip may be broken into two or more segments, T1, T2, and T3, though as discussed herein, it is possible to consider the trip as a single segment. As discussed herein, the segment boundaries may not result in equal-length segments. Instead the segments use natural or mission specific boundaries. Optimal trip plans are pre-computed for each segment. If fuel use versus trip time is the trip object to be met, fuel versus trip time curves are generated for each segment. As discussed herein, the curves may be based on other factors wherein the factors are objectives to be met with a trip plan. When trip time is the parameter being determined, trip time for each segment is computed while satisfying the overall trip time constraints.

FIG. 6 illustrates speed limits for an exemplary three segment 200 mile trip 97. Further illustrated are grade changes over the 200 mile trip 98. A combined chart 99 illustrating curves of fuel used for each segment of the trip over the travel time is also shown.

Using the optimal control setup described previously, the present computation method can find the trip plan with specified travel time and initial and final speeds, to satisfy all the speed limits and locomotive capability constraints when there are stops. Though the following detailed discussion is directed to optimizing fuel use, it can also be applied to optimize other factors as discussed herein, such as, but not limited to, emissions. The method can accommodate desired dwell times at stops and considers constraints on earliest arrival and departure at a location as may be required, for example, in single-track operations where the time to enter or pass a siding is critical.

Examples of the present invention find a fuel-optimal trip from distance $D_0$ to $D_M$, traveled in time T, with M−1 inter mediate stops at $D_1, \ldots, D_{M-1}$, and with the arrival and departure times at these stops constrained by $$t_{min}(i) \le t_{arr}(D_i) \le t_{max}(i) - \Delta t_i$$

$$t_{arr}(D_i) + \Delta t_i \le t_{dep}(D_i) \le t_{max}(i) \; i = 1, \ldots, M-1$$

where $t_{arr}(D_i)$, $t_{dep}(D_i)$, and $\Delta t_i$ are the arrival, departure, and minimum stop time at the $i^{th}$ stop, respectively. Assuming that fuel-optimality implies minimizing stop time, therefore $t_{dep}(D_i) = t_{arr}(D_i) + \Delta t_i$ which eliminates the second inequality above. Suppose for each i=1, . . . , M, the fuel-optimal trip from $D_{i-1}$ to $D_i$ for travel time t, $T_{min}(i) \le t \le T_{max}(i)$, is known. Let $F_i(t)$ be the fuel-use corresponding to this trip. If the travel time from $D_{j-1}$ to $D_j$ is denoted $T_j$, then the arrival time at $D_i$ is given by $$t_{arr}(D_i) = \sum_{j=1}^{i} (T_j + \Delta t_{j-1})$$

where $\Delta t_0$ is defined to be zero. The fuel-optimal trip from $D_0$ to $D_M$ for travel time T is then obtained by finding $T_i$, i=1, . . . , M, which minimizes $$\sum_{i=1}^{M} F_i(T_i)$$

$$T_{\min}(i) \le T_i \le T_{\max}(i)$$

subject to $$t_{\min}(i) \le \sum_{j=1}^{i} (T_j + \Delta t_{j-1}) \le t_{\max}(i) - \Delta t_i$$

$$i = 1, \ldots, M-1$$

$$\sum_{j=1}^{M} (T_j + \Delta t_{j-1}) = T$$

Once a trip is underway, the issue is re-determining the fuel-optimal solution for the remainder of the trip (originally from $D_0$ to $D_M$ in time T) as the trip is traveled, but where disturbances preclude following the fuel-optimal solution. Let the current distance and speed be x and v, respectively, where $D_{i-1} < x \le D_i$. Also, let the current time since the beginning of the trip be $t_{act}$. Then the fuel-optimal solution for the remainder of the trip from x to $D_M$, which retains the original arrival time at $D_M$, is obtained by finding $\tilde{T}_i$, $T_j$, j=i+1, . . . M, which minimizes $$\tilde{F}_i(\tilde{T}_i, x, v) + \sum_{j=i+1}^{M} F_j(T_j)$$

subject to $$t_{\min}(i) \le t_{act} + \tilde{T}_i \le t_{\max}(i) - \Delta t_i$$

$$t_{\min}(k) \le t_{act} + \tilde{T}_i + \sum_{j=i+1}^{k} (T_j + \Delta t_{j-1}) \le t_{\max}(k) - \Delta t_k$$

$$k = i+1, \ldots, M-1$$

-continued $$t_{act} + \tilde{T}_i + \sum_{j=i+1}^{M} (T_j + \Delta t_{j-1}) = T$$

Here, $\tilde{F}_i(t,x,v)$ is the fuel-used of the optimal trip from x to $D_i$, traveled in time t, with initial speed at x of v.

As discussed above, an exemplary process to enable more efficient re-planning constructs the optimal solution for a stop-to-stop trip from partitioned segments. For the trip from $D_{i-1}$ to $D_i$, with travel time $T_i$, choose a set of intermediate points $D_{ij}$=1, . . . , $N_i$−1. Let $D_{i0} = D_{i-1}$, and $D_{iN_i} = D_i$. Then express the fuel-use for the optimal trip from $D_{i-1}$ to $D_i$ as $$F_i(t) = \sum_{j=1}^{N_i} f_{ij}(t_{ij} - t_{i,j-1}, v_{i,j-1}, v_{ij})$$

where $f_{ij}(t, v_{i,j-1}, v_{ij})$ is the fuel-use for the optimal trip from $D_{i,j-1}$ to $D_{ij}$, traveled in time t, with initial and final speeds of $v_{i,j-1}$ and $v_{ij}$. Furthermore, $t_{ij}$ is the time in the optimal trip corresponding to distance $D_{ij}$. By definition, $t_{iN_i} - t_{i0} = T_i$. Since the train is stopped at $D_{i0}$ and $D_{iN_i}$, $v_{i0} = v_{iN_i} = 0$.

The above expression enables the function $F_i(t)$ to be alternatively determined by first determining the functions $f_{ij}(\bullet)$, $1 \le j \le N_i$, then finding $\tau_{ij}, 1 \le j \le N_i$ and $v_{ij}, 1 \le j \le N_i$, which minimize $$F_i(t) = \sum_{j=1}^{N_i} f_{ij}(\tau_{ij}, v_{i,j-1}, v_{ij})$$

subject to $$\sum_{j=1}^{N_i} \tau_{ij} = T_i$$

$$v_{\min}(i, j) \le v_{ij} \le v_{\max}(i, j)$$

$$j = 1, \ldots, N_i - 1$$

$$v_{i0} = v_{iN_i} = 0$$

By choosing $D_{ij}$ (e.g., at speed restrictions or meeting points), $v_{max}(i,j) - v_{min}(i,j)$ can be minimized, thus minimizing the domain over which $f_{ij}(\ )$ needs to be known.

Based on the partitioning above, a simpler suboptimal re-planning approach than that described above is to restrict re-planning to times when the train is at distance points $D_{ij}$, $1 \le i \le M, 1 \le j \le N_i$. At point $D_{ij}$, the new optimal trip from $D_{ij}$ to $D_M$ can be determined by finding $\tau_{ik}, j < k \le N_i$, $v_{ik}, j < k < N_i$, and $\tau_{mn}$, $i < m \le M$, $1 \le n \le N_m$, $v_{mn}$, $i < m \le M$, $1 \le n < N_m$, which minimize $$\sum_{k=j+1}^{N_i} f_{ik}(\tau_{ik}, v_{i,k-1}, v_{ik}) + \sum_{m=i+1}^{M} \sum_{n=1}^{N_m} f_{mn}(\tau_{mn}, v_{m,n-1}, v_{mm})$$

subject to $$t_{\min}(i) \le t_{act} + \sum_{k=j+1}^{N_i} \tau_{ik} \le t_{\max}(i) - \Delta t_i$$

-continued $$t_{\min}(n) \le t_{act} + \sum_{k=j+1}^{N_i} \tau_{ik} + \sum_{m=i+1}^{n} (T_m + \Delta t_{m-1}) \le t_{\max}(n) - \Delta t_n$$

$$n = i+1, \ldots, M-1$$

$$t_{act} + \sum_{k=j+1}^{N_i} \tau_{ik} + \sum_{m=i+1}^{M} (T_m + \Delta t_{m-1}) = T$$

where $$T_m = \sum_{n=1}^{N_m} \tau_{mn}$$

A further simplification is obtained by waiting on the re-computation of $T_m$, $i<m\le M$, until distance point $D_i$ is reached. In this way, at points $D_{ij}$ between $D_{i-1}$ and $D_i$, the minimization above needs only be performed over $\tau_{ik}$, $j<k\le N_i$, $v_{ij}$, $j<k<N_i$. $T_i$ is increased as needed to accommodate any longer actual travel time from $D_{i-1}$ to $D_{ij}$ than planned. This increase is later compensated, if possible, by the re-computation of $T_m$, $i<m\le M$, at distance point $D_i$.

With respect to the closed-loop configuration disclosed above, the total input energy required to move a train 31 from point A to point B consists of the sum of four components, specifically difference in kinetic energy between the points A and B; difference in potential energy between the points A and B; energy loss due to friction and other drag losses; and energy dissipated by the application of the brakes. Assuming the start and end speeds are equal (e.g., stationary) the first component is zero. Furthermore, the second component is independent of driving strategy. Thus, it suffices to minimize the sum of the last two components.

Following a constant speed profile minimizes drag loss. Following a constant speed profile also minimizes total energy input when braking is not needed to maintain constant speed. However, if braking is required to maintain constant speed, applying braking just to maintain constant speed will most likely increase total required energy because of the need to replenish the energy dissipated by the brakes. A possibility exists that some braking may actually reduce total energy usage if the additional brake loss is more than offset by the resultant decrease in drag loss caused by braking, by reducing speed variation.

After completing a re-plan from the collection of events described above, the new optimal notch/speed plan can be followed using the closed loop control described herein. However, in some situations there may not be enough time to carry out the segment-decomposed planning described above, and particularly when there are critical speed restrictions that must be respected, an alternative may be preferred. Examples of the present invention accomplish this with an algorithm referred to as "smart cruise control". The smart cruise control algorithm is an efficient process for generating, on the fly, an energy-efficient (hence fuel-efficient) suboptimal prescription for driving the train 31 over a known terrain. This algorithm assumes knowledge of the position of the train 31 along the track 34 at all times, as well as knowledge of the grade and curvature of the track versus position. The method relies on a point-mass model for the motion of the train 31, whose parameters may be adaptively estimated from online measurements of train motion as described earlier.

The smart cruise control algorithm has three principal components, specifically a modified speed limit profile that serves as an energy-efficient guide around speed limit reductions; an ideal throttle or dynamic brake setting profile that attempts to balance minimizing speed variations and braking; and a mechanism for combining the latter two components to produce a notch command, employing a speed feedback loop to compensate for mismatches of modeled parameters when compared to reality parameters. Smart cruise control can accommodate strategies in examples of the present invention without active braking (i.e. the driver is signaled and assumed to provide the requisite braking) or a variant that does provide active braking.

With respect to the cruise control algorithm that does not control dynamic braking, the three exemplary components are a modified speed limit profile that serves as an energy-efficient guide around speed limit reductions, a notification signal to notify the operator when braking should be activated, an ideal throttle profile that attempts to balance minimizing speed variations and notifying the operator to apply brakes and a mechanism employing a feedback loop to compensate for mismatches of model parameters to reality parameters.

Also included in examples of the present invention is an approach to identify key parameter values of the train 31. For example, with respect to estimating train mass, a Kalman filter and a recursive least-squares approach may be utilized to detect errors that may develop over time.

Figure 7:
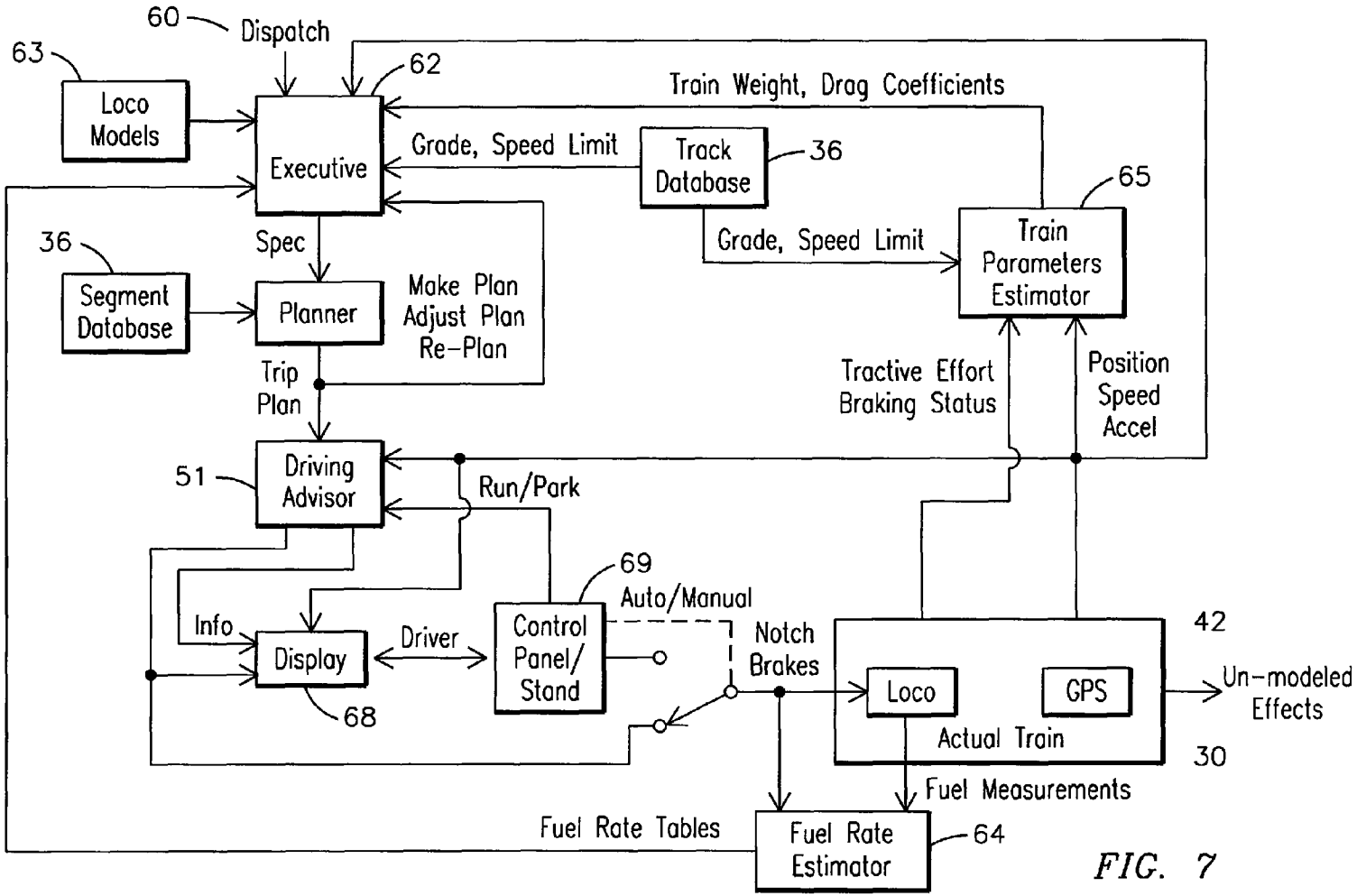
FIG. 7 depicts an exemplary flow chart for trip optimization.

FIG. 7 depicts an exemplary flow chart for trip optimization. As discussed previously, a remote facility, such as a dispatch center 60 can provide information for use by examples of the present invention. As illustrated, such information is provided to an executive control element 62. Also supplied to the executive control element 62 is a locomotive modeling information database 63, a track information database 36 such as, but not limited to, track grade information and speed limit information, estimated train parameters such as, but not limited to, train weight and drag coefficients, and fuel rate tables from a fuel rate estimator 64. The executive control element 62 supplies information to the planner 12, which is disclosed in more detail in FIG. 1. Once a trip plan has been calculated, the plan is supplied to a driving advisor, driver or controller element 51. The trip plan is also supplied to the executive control element 62 so that it can compare the trip when other new data is provided.

As discussed above, the driving advisor 51 can automatically set a notch power, either a pre-established notch setting or an optimum continuous notch power value. In addition to supplying a speed command to the locomotive 31, a display 68 is provided so that the operator can view what the planner has recommended. The operator also has access to a control panel 69. Through the control panel 69 the operator can decide whether to apply the notch power recommended. Towards this end, the operator may limit a targeted or recommended power. That is, at any time the operator always has final authority over the power setting for operation of the locomotive consist, including whether to apply brakes if the trip plan recommends slowing the train 31. For example, if operating in dark territory, or where information from wayside equipment cannot electronically transmit information to a train and instead the operator views visual signals from the wayside equipment, the operator inputs commands based on information contained in the track database and visual signals from the wayside equipment. Based on how the train 31 is functioning, information regarding fuel measurement is supplied to the fuel rate estimator 64. Since direct measurement of fuel flows is not typically available in a locomotive consist, all information on fuel consumed to a point in the trip and projections into the future if the optimal plans are followed use calibrated physics models, such as those used in developing the optimal plans. For example, such predictions may include, but are not limited to, the use of measured gross horsepower and known fuel characteristics to derive the cumulative fuel used.

The train 31 also has a locator device 30 such as a GPS sensor, as discussed above. Information is supplied to the train parameters estimator 65. Such information may include, but is not limited to, GPS sensor data, tractive/braking effort data, braking status data, speed and any changes in speed data. With information regarding grade and speed limit information, train weight and drag coefficients information is supplied to the executive control element 62.

Examples of the present invention may also allow for the use of continuously variable power throughout the optimization planning and closed loop control implementation. In a conventional locomotive, power is typically quantized to eight discrete levels. Modern locomotives can realize continuous variation in horsepower that may be incorporated into the previously described optimization methods. With continuous power, the locomotive 42 can further optimize operating conditions, e.g., by minimizing auxiliary loads and power transmission losses, and fine tuning engine horsepower regions of optimum efficiency or to points of increased emissions margins. Example include, but are not limited to, minimizing cooling system losses, adjusting alternator voltages, adjusting engine speeds, and reducing number of powered axles. Further, the locomotive 42 may use the on-board track database 36 and the forecasted performance requirements to minimize auxiliary loads and power transmission losses to provide optimum efficiency for the target fuel consumption/emissions. Examples include, but are not limited to, reducing a number of powered axles on flat terrain and precooling the locomotive engine prior to entering a tunnel.

Examples of the present invention may also use the on-board track database 36 and the forecasted performance to adjust the locomotive performance, such as to ensure that the train has sufficient speed as it approaches a hill and/or tunnel. For example, this could be expressed as a speed constraint at a particular location that becomes part of the optimal plan generation created solving the equation (OP). Additionally, examples of the present invention may incorporate train-handling rules, such as, but not limited to, tractive effort ramp rates and maximum braking effort ramp rates. These may incorporated directly into the formulation for optimum trip profile or alternatively incorporated into the closed loop regulator used to control power application to achieve the target speed.

In a preferred embodiment the present invention is installed only on a lead locomotive of the train consist. Even though examples of the present invention are not dependent on data or interactions with other locomotives, it may be integrated with a consist manager, as disclosed in U.S. Pat. No. 6,691,957 and patent application Ser. No. 10/429,596 (both owned by the Assignee and both incorporated by reference), functionality and/or a consist optimizer functionality to improve efficiency. Interaction with multiple trains is not precluded as illustrated by the example of dispatch arbitrating two "independently optimized" trains described herein.

Examples of the present invention may be used with consists in which the locomotives are not contiguous, e.g., with one or more locomotives up front, others in the middle and at the rear for train. Such configurations are called distributed power wherein the standard connection between the locomotives is replaced by radio link or auxiliary cable to link the locomotives externally. When operating in distributed power, the operator in a lead locomotive can control operating functions of remote locomotives in the consist via a control system, such as a distributed power control element. In particular, when operating in distributed power, the operator can command each locomotive consist to operate at a different notch power level (or one consist could be in motoring and other could be in braking) wherein each individual in the locomotive consist operates at the same notch power.

Trains with distributed power systems can be operated in different modes. In one mode all locomotives in the train operate at the same notch command. If the lead locomotive is commanding motoring at notch N8, all units in the train are commanded to generate motoring at notch N8. In an "independent" control mode, locomotives or sets of locomotives distributed throughout the train can be operated at different motoring or braking powers. For example, as a train crests a mountaintop, the lead locomotives (on the down slope of mountain) may be placed in braking mode, while the locomotives in the middle or at the end of the train (on the up slope of mountain) may be in motoring. This is done to minimize tensile forces on the mechanical couplers that connect the railcars and locomotives. Traditionally, operating the distributed power system in "independent" mode required the operator to manually command each remote locomotive or set of locomotives via a display in the lead locomotive. Using the physics based planning model, train set-up information, on-board track database, on-board operating rules, location determination system, real-time closed loop power/brake control, and sensor feedback, the system can automatically operate the distributed power train in "independent" mode.

When operating in distributed power, the operator in a lead locomotive can control operating functions of remote locomotives in the remote consists via a control system, such as a distributed power control element. Thus when operating in distributed power, the operator can command each locomotive consist to operate at a different notch power level (or one consist could be in motoring and other could be in braking) wherein each individual locomotive in the locomotive consist operates at the same notch power. In an exemplary embodiment, with the present invention installed on the train, preferably in communication with the distributed power control element, when a notch power level for a remote locomotive consist is desired as recommended by the optimized trip plan, an example of the present invention communicates this power setting to the remote locomotive consists for implementation. As discussed below, brake applications are similarly implemented.

When operating with distributed power, the optimization problem previously described can be enhanced to allow additional degrees of freedom, in that each of the remote units can be independently controlled from the lead unit. The value of this is that additional objectives or constraints relating to in-train forces may be incorporated into the performance function, assuming the model to reflect the in-train forces is also included. Thus examples of the present invention may include the use of multiple throttle controls to better manage in-train forces as well as fuel consumption and emissions.

In a train utilizing a consist manager, the lead locomotive in a locomotive consist may operate at a different notch power setting than other locomotives in that consist. The other locomotives in the consist operate at the same notch power setting. Examples of the present invention may be utilized in conjunction with the consist manager to command notch power settings for the locomotives in the consist. Thus based on examples of the present invention, since the consist manager divides a locomotive consist into two groups, lead locomotive and trailing units, the lead locomotive will be commanded to operate at a certain notch power and the trail locomotives can be commanded to operate at a different notch power. In an exemplary embodiment the distributed power control element may be the system and/or apparatus where this operation is performed.

Likewise, when a consist optimizer is used with a locomotive consist, examples of the present invention can be used in conjunction with the consist optimizer to determine notch power for each locomotive in the locomotive consist. For example, suppose that a trip plan recommends a notch power setting of four for the locomotive consist. Based on the location of the train, the consist optimizer will take this information and then determine the notch power setting for each locomotive in the consist In this implementation, the efficiency of setting notch power settings over intra-train communication channels is improved. Furthermore, as discussed above, implementation of this configuration may be performed utilizing the distributed control system.

Figure 8:
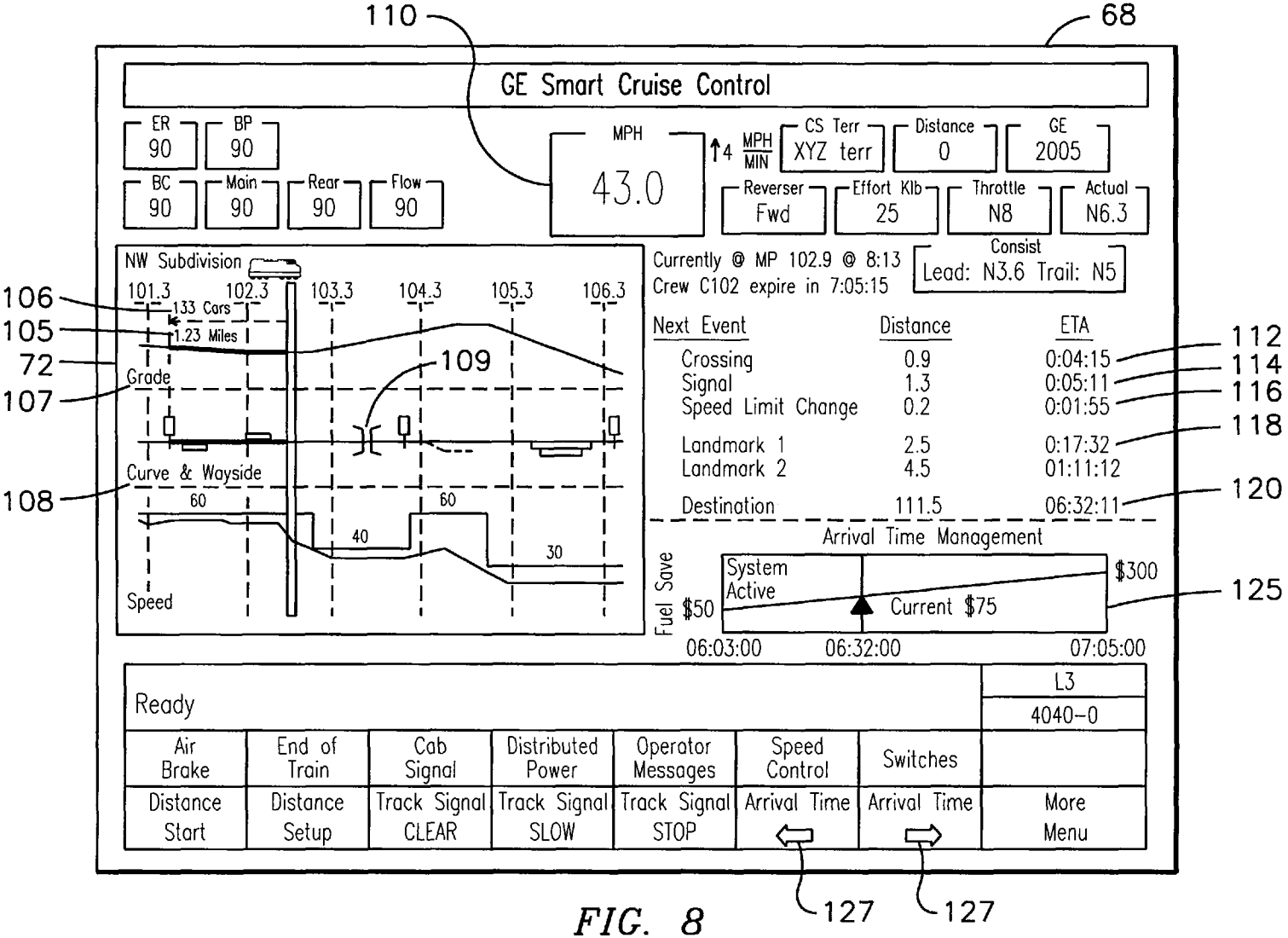
FIG. 8 depicts an exemplary illustration of a dynamic display for use by the operator.
Figure 9:
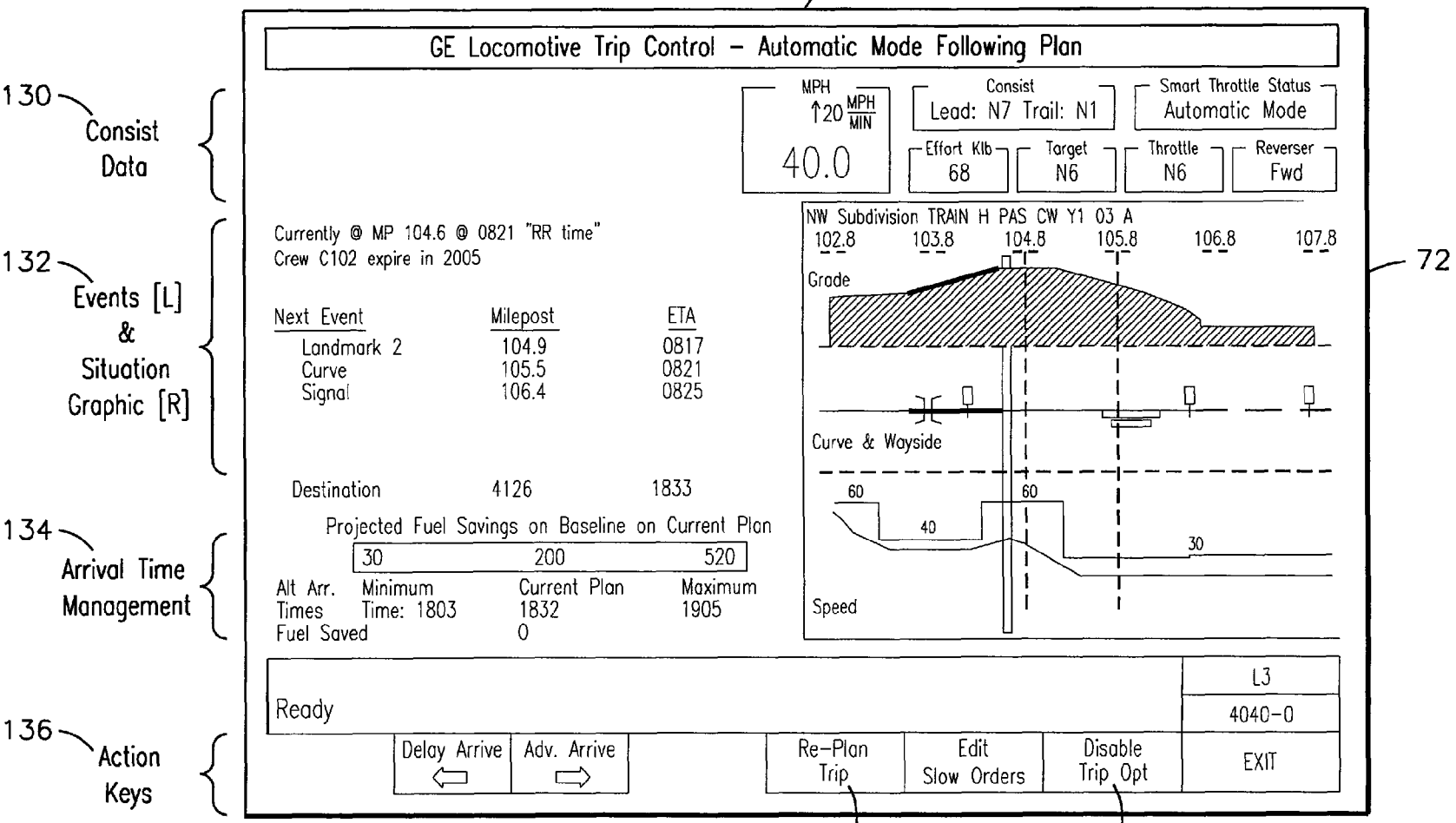
FIG. 9 depicts another exemplary illustration of a dynamic display for use by the operator.
Figure 10:
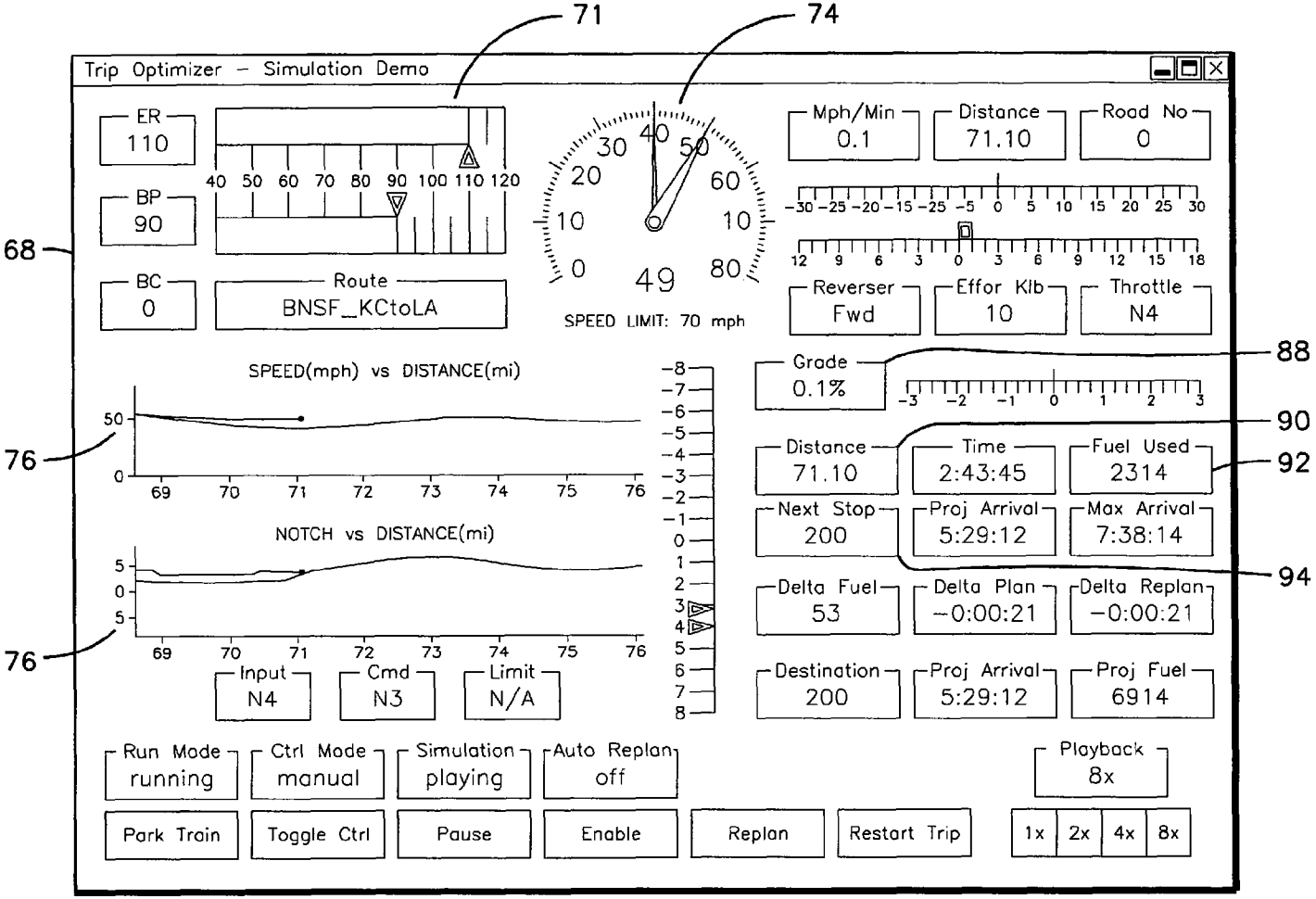
FIG. 10 depicts another exemplary illustration of a dynamic display for use by the operator.

Furthermore, as discussed previously, examples of the present invention may be used for continuous corrections and re-planning with respect to when the train consist uses braking based on upcoming items of interest, such as but not limited to railroad crossings, grade changes, approaching sidings, approaching depot yards and approaching fuel stations where each locomotive in the consist may require a different braking option. For example, if the train is coming over a hill, the lead locomotive may have to enter a braking condition whereas the remote locomotives, having not FIGS. 8, 9 and 10 depict exemplary illustrations of dynamic displays for use by the operator. FIG. 8 illustrates a provided trip profile 72. Within the profile a location 73 of the locomotive is indicated. Such information as train length 105 and the number of cars 106 in the train is provided. Elements are also provided regarding track grade 107, curve and wayside elements 108, including bridge location 109 and train speed 110. The display 68 allows the operator to view such information and also see where the train is along the route. Information pertaining to distance and/or estimated time of arrival to such locations as crossings 112, signals 114, speed changes 116, landmarks 118 and destinations 120 is provided. An arrival time management tool 125 is also provided to allow the user to determine the fuel savings realized during the trip. The operator has the ability to vary arrival times 127 and witness how this affects the fuel savings. As discussed herein, those skilled in the art will recognize that fuel saving is an exemplary example of only one objective that can be reviewed with a management tool. Thus, depending on the parameter being viewed, other parameters, discussed herein can be viewed and evaluated with a management tool visible to the operator. The operator is also provided with information regarding the time duration that the crew has been operating the train. In exemplary embodiments time and distance information may either be illustrated as the time and/or distance until a particular event and/or location or it may provide a total elapsed time.

As illustrated in FIG. 9 an exemplary display provides information about consist data 130, an events and situation graphic 132, an arrival time management tool 134 and action keys 136. Similar information as discussed above is provided in this display as well. This display 68 also provides action keys 138 to allow the operator to re-plan as well as to disengage 140 an example of the present invention.

FIG. 10 depicts another exemplary embodiment of the display. Typical information for a modern locomotive including air-brake status 72, analog speedometer with digital inset 74, and information about tractive effort in pounds force (or traction amps for DC locomotives) is visible. An indicator 74 shows the current optimal speed in the plan being executed as well as an accelerometer graphic to supplement the readout in mph/minute. Important new data for optimal plan execution is in the center of the screen, including a rolling strip graphic 76 with optimal speed and notch setting versus distance compared to the current history of these variables. In this exemplary embodiment, location of the train is derived using the locator element. As illustrated, the location is provided by identifying how far the train is away from its final destination, an absolute position, an initial destination, an intermediate point and/or an operator input.

The strip chart provides a look-ahead to changes in speed required to follow the optimal plan, which is useful in manual control and monitors plan versus actual during automatic control. As discussed herein, such as when in the coaching mode, the operator can either follow the notch or speed suggested by an example of the present invention. The vertical bar gives a graphic of desired and actual notch, which are also displayed digitally below the strip chart. When continuous notch power is utilized, as discussed above, the display will simply round to closest discrete equivalent, the display may be an analog display so that an analog equivalent or a percentage or actual horse power/tractive effort is displayed.

Critical information on trip status is displayed on the screen, and shows the current grade the train is encountering 88, either by the lead locomotive, a location elsewhere along the train or an average over the train length. A cumulative distance traveled in the plan 90, cumulative fuel used 92, the location of or the distance to the next stop as planned 94 and current and projected arrival time 96 at the next stop are also disclosed. The display 68 also shows the maximum possible time to destination with the computed plans available. If a later arrival is required, a re-plan is executed. Delta plan data shows status for fuel and schedule ahead or behind the current optimal plan. Negative numbers mean less fuel or early compared to plan, positive numbers mean more fuel or late compared to plan. Typically these parameters trade-off in opposite directions (slowing down to save fuel makes the train late and conversely).

At all times these displays 68 gives the operator a snapshot of the trip status with respect to the currently instituted driving plan. This display is for illustrative purpose only as there are many other ways of displaying/conveying this information to the operator and/or dispatch. Towards this end, any other items of information disclosed above can be added to the display to provide a display that is different than those disclosed.

Other features that may be included in examples of the present invention include, but are not limited to, generating of data logs and reports. This information may be stored on the train and downloaded to an off-board system. The downloads may occur via manual and/or wireless transmission. This information may also be viewable by the operator via the locomotive display. The data may include such information as, but not limited to, operator inputs, time system is operational, fuel saved, fuel imbalance across locomotives in the train, train journey off course and system diagnostic issues, such as a GPS sensor malfunction.

Since trip plans must also take into consideration allowable crew operation time, examples of the present invention may take such information into consideration as a trip is planned. For example, if the maximum time a crew may operate is eight hours, then the trip can be fashioned to include stopping location for a new crew to replace the present crew. Such specified stopping locations may include, but are not limited to rail yards, meet/pass locations, etc. If, as the trip progresses, the trip time may be exceeded, examples of the present invention may be overridden by the operator to meet other criteria as determined by the operator. Ultimately, regardless of the operating conditions of the train, such as but not limited to high load, low speed, train stretch conditions, etc., the operator remains in control to command a safe speed and/or operating condition of the train.

Using exemplary embodiment of the present invention, the train may operate in a plurality of different operational concepts. In one operational concept an example of the present invention provides commands for commanding propulsion and dynamic braking. The operator handles all other train functions. In another operational concept, an example of the present invention provides commands for commanding propulsion only. The operator handles dynamic braking and all other train functions. In yet another operational concept, an example of the present invention provides commands for commanding propulsion, dynamic braking and application of the airbrake. The operator handles all other train functions.

An example of the present invention may also notify the operator of upcoming items of interest or actions to be taken, such as forecasting logic of an example of the present invention, the continuous corrections and re-planning to the optimized trip plan, the track database. The operator can also be notified of upcoming crossings, signals, grade changes, brake actions, sidings, rail yards, fuel stations, etc. These notifications may occur audibly and/or through the operator interface.

Specifically using the physics based planning model, train set-up information, on-board track database, on-board operating rules, location determination system, real-time closed loop power/brake control, and sensor feedback, the system presents and/or notify the operator of required actions. The notification can be visual and/or audible. Examples include notification of crossings that require the operator to activate the locomotive horn and/or bell and "silent" crossings that do not require the operator to activate the locomotive horn or bell.

In another exemplary embodiment, using the physics based planning model discussed above, train set-up information, on-board track database, on-board operating rules, location determination system, real-time closed power/brake control, and sensor feedback, an example of the present invention may present the operator information (e.g. a gauge on display) that allows the operator to see when the train will arrive at various locations, as illustrated in FIG. 9. The system allows the operator to adjust the trip plan (target arrival time). This information (actual estimated arrival time or information needed to derive off-board) can also be communicated to the dispatch center to allow the dispatcher or dispatch system to adjust the target arrival times. This allows the system to quickly adjust and optimize for the appropriate target function (for example trading off speed and fuel usage).

Based on the information provided above, exemplary embodiments of the invention may be used to determine a location of the train 31 on a track, step 18. A determination of the track characteristic may also be accomplished, such as by using the train parameter estimator 65. A trip plan may be created based on the location of the train, the characteristic of the track, and an operating condition of at least one locomotive of the train. Furthermore, an optimal power requirement may be communicated to train wherein the train operator may be directed to a locomotive, locomotive consist and/or train in accordance with the optimal power, such as through the wireless communication system 47. In another example instead of directing the train operator, the train 31, locomotive consist 18, and/or locomotive may be automatically operated based on the optimal power setting.

Additionally a method may also involve determining a power setting, or power commands 14, for the locomotive consist 18 based on the trip plan. The locomotive consist 18 is then operated at the power setting. Operating parameters of the train and/or locomotive consist may be collected, such as but not limited to actual speed of the train, actual power setting of the locomotive consist, and a location of the train. At least one of these parameters can be compared to the power setting the locomotive consist is commanded to operated at.

In another embodiment, a method may involve determining operational parameters 62 of the train and/or locomotive consist. A desired operational parameter is determined based on determined operational parameters. The determined parameter is compared to the operational parameter. If a difference is detected, the trip plan is adjusted, step 24.

Another embodiment may entail a method where a location of the train 31 on the track 34 is determined. A characteristic of the track 34 is also determined. A trip plan, or drive plan, is developed, or generated in order to minimize fuel consumption. The trip plan may be generated based on the location of the train, the characteristic of the track, and/or the operating condition of the locomotive consist 18 and/or train 31. In a similar method, once a location of the train is determined on the track and a characteristic of the track is known, propulsion control and/or notch commands are provided to minimize fuel consumption.

Though the description below discloses database augmentation being performed with respect to trip optimizer, utilizing database augmentation with trip optimization does not necessary have to occur. Thus, a trip optimized plan does not need to be updated based on an augmented database. Instead, the augmented database may be used for future optimized trip plans.

As described above, the various trip optimizer algorithms use track and/or train (herein track/train) information (in one embodiment stored within the database 63 of FIG. 7) to plan the optimized trip over individual track segments, collectively forming an optimized train trip over a track path comprising several track segments. The algorithms determine a train speed trajectory and in a closed-loop embodiment control the train according to that trajectory. Alternatively, the optimizer advises the train operator of the desired optimal speed trajectory during the trip, permitting the operator to control the train according to the presented trajectory. However, the operator may be aware of operational conditions that motivate him to deviate from the presented optimal trajectory.

According to one embodiment of the present invention, the track database information, comprising elements characterizing the track, is updated and incorporated into the plan adjustment process (as represented by the block 26 of FIG. 1) and/or incorporated into the re-plan process (as represented by the block 24 of FIG. 1) to improve the optimization results. The adjusted plan or the new plan improve the locomotive's fuel efficiency (or another parameter that is optimized according to the trip optimizer of an example of the present invention) to realize an operational benefit or savings for the train or the railroad network.

Track characterizing information comprises allowed speed, speed restrictions, track grade, track age, track condition, weather conditions, etc., further including any track information that affects the ability to propel the locomotive or stop the locomotive (e.g., track friction coefficient) on the track.

Train data may also be stored in the database 63. For example, the tractive effort and braking effort applied by the train as it traverses a track segment can be determined and stored in the database 63 for use by the optimizer algorithm to generate the speed trajectory. For example, if a train slows at a particular location on the track due to a track problem, the trip optimizer can accordingly slow the train in the same region during subsequent trips over the affected track segment. The trip optimizer thereby creates a plan that is more realistic and in accordance with actual train operations along the track segment. Alternatively the trip optimizer may take this into account and plan the trip accordingly, or correct the track database for the future applications.

After the track problem is resolved, a train traversing the affected track will determine that the problem has been resolved, update its database accordingly, and supply the updated track information to other trains scheduled to traverse the track segment and/or to a remote central repository from where the updated track information can be used in generating optimized trip plans for other trains. The trip optimizer can then optimize travel over that track segment without the constraint caused by the damaged track.

According to an exemplary embodiment of the present invention, updated or more recent track characterizing information is stored in the database 63 and supplied to the trip optimizer algorithm to update and improve the accuracy of the track database. For example, track altitude information stored in the database 63 may include an actual altitude measurement at a predetermined occurrence, such as, but not limited to, a specific distance such as every mile, every point the grade changes and/or every time track curvature changes, with altitude values interpolated between two successive altitude data points. To improve the accuracy of the altitude information and avoid the interpolated estimates, according to one embodiment of the invention location information, such as determined by a GPS (Global Positioning System) location information, including both a geographical location and the altitude at the location, is determined and provided to the database 63. This information can be collected in real time as the train traverses a track segment and uploaded directly to the database 63. The information can also be collected by train personnel (track maintenance personnel, for example) and provided to a central repository for eventual uploading to the database 63 or provided to any database from which the algorithm discussed above extracts track information to compute the optimal trip trajectory. The improved altitude information should generate a more accurate and therefore more efficient speed trajectory, improving the train's fuel efficiency.

In another embodiment of the invention, various sensors mounted on a locomotive, railcar or the end-of-train device sense these track-related conditions and provide data relative to the sensed conditions for storing in the database 63. For example, a video or still camera mounted on the locomotive collects track data for later analysis and interpretation. Results of the analysis are uploaded to the database 63 of any trains traversing the track segment.

Updated track information can be used locally, i.e., by the train collecting the information to revise the executing trip plan in real time. The information can also be uploaded to other trains or to a central repository for use in conjunction with optimized trip plans for other trains that will later traverse the track segment.

Updated information supplied by multiple trains traversing the track segment can be aggregated for use in creating future trip plans. The aggregate data can also be analyzed for trends or probable conditions. For example, if the track information indicates certain likely weather conditions over a specific time interval for a specific track segment, the trip optimization process and algorithm can consider the effects of these weather/seasonal conditions when creating trip plans for that track segment during the specified time interval. Notwithstanding the weather conditions may differ from the expected condition when a train actually traverses the track segment, the trip optimizer has optimized the majority of the trips over that segment during the time interval of interest.

In another embodiment, the tractive effort, braking effort, inertia and/or speed are used to determine the track grade. In any notch position (including notch idle position), the rate of change of the train's speed is affected by drag and track grade. To determine the track grade, the rate of change of speed is determined and compared with the expected change in speed. A mismatch indicates that the assumed track grade is not correct.

The mismatch may be confirmed with multiple trains for statistical significance and to make sure an error has occurred due to estimation due to sensor errors or other noise parameters, like wind/drag. Any deviation from the expected/projected may mean that either the assumed train parameters (weight, drag, length etc) and/or track parameters (grade, curvature etc) are not correct. The train parameters if assumed wrong will generally manifest throughout the trip or a significant portion of the trip; whereas track parameter mismatches will usually manifest only at the points of mismatch. The train parameter mismatch determination can enhance the rest of trip performance or can be used to correct future trips if there is a consistent mismatch. Whenever a train parameter error is determined it can be used for the rest of the trip. However if the drag coefficient, for example, assumed for all the trains of a particular type is in error, then the future plans for every train of that type could be corrected.

An inertia value can be assumed constant throughout a trip and therefore train performance information can confirm whether the inertia value is correct, the assumed inertia can be used for the track grade calculations. For example every time there is tractive effort change, the corresponding acceleration change determines the inertia of the train (assuming there is no grade change at the same time there is a tractive effort change). Moreover the effect of a grade change has a gradual effect on the train acceleration since the weighted average grade drives the acceleration changes. For example, the tractive effort change can be observed at every notch change, and since multiple observations can be made, the effect of grade and drag changes can be averaged out to zero. Once the inertia is known, the grade can be determined based on the deviation of acceleration from the expected acceleration assuming that the drag coefficient has not changed at the same time. Similarly the assumed drag value can be compared with operation before and after the point of interest. The assumed drag value can be also determined from many trains traversing the same segment.

In another example, multiple trains traversing the track may all encounter unexpected wheel slip. Analysis of the collected data may indicate a failed track lubricating system. The trip optimizer can include this slip condition in its trip plan. When the lubricating system is repaired, later trains traversing the track will not indicate an excessive wheel slip and the track database updated accordingly, responsive to which the trip optimizer removes that condition from the trip planning process. Similarly, data about weather conditions which may affect travel time may be collected. The trip optimize may include weather conditions in its trip plan. Once the weather conditions improve, the track database may be updated wherein the trip optimizer removes that condition from the trip planning process.

For those locomotives equipped with a signal sensing system, signal information for track blocks ahead of the present track block can also be provided to the trip optimizer. Wayside equipment can also be used to determine and provide updated track information for the database 63. For example, wayside equipment can determine certain rail and train conditions (e.g., wheel bearing temperatures, number of railcars and axles in the train, wheel profile) and transmit this information to the train as it passes the wayside equipment. An end-of-train device can be equipped with sensors to determine track information and a communications device to supply the information to the database 63.

Train inertia, operator-applied tractive effort, operator-applied braking effort, locomotive speed, locomotive distance from a known location, barometric pressure, loco-cam video information (i.e., from a train-mounted video camera) and operator inputs over specific track segments can be stored in the database 63 and used by the trip optimizer algorithm to improve the optimization process. The subject operating information can be collected by all trains traversing the track segment. Each train can provide the collected information to the database 63 for use by the trip optimizer executing on the train.

Additionally, to allow other trains that may later traverse the track segment to have the advantage of this information, the collected information is uploaded to a database that all trains access or that the trip optimizer algorithm accesses as it prepares optimized trip plans for trains traveling the track segment of interest. Although, these additional inputs may not necessarily result in a more optimal solution trajectory, they will result in a more accurate trajectory vis-à-vis actual operator braking and tractive effort applications over the track segment of interest.

Certain collected train operational data, as described above, can be used directly by the trip optimizer. For example, track altitude directly affects fuel consumption and can be used by the optimization algorithm to more accurately determine fuel consumption and thereby optimize fuel consumption.

Certain track characteristics are calculated from collected operational data. The determined track characteristics are then used in the optimization algorithms. For example, the measured power (tractive effort or notch position) and acceleration are used to determine the track grade at a specific location on the track segment. The calculated grade is then used by the optimization algorithm.

Figure 11:
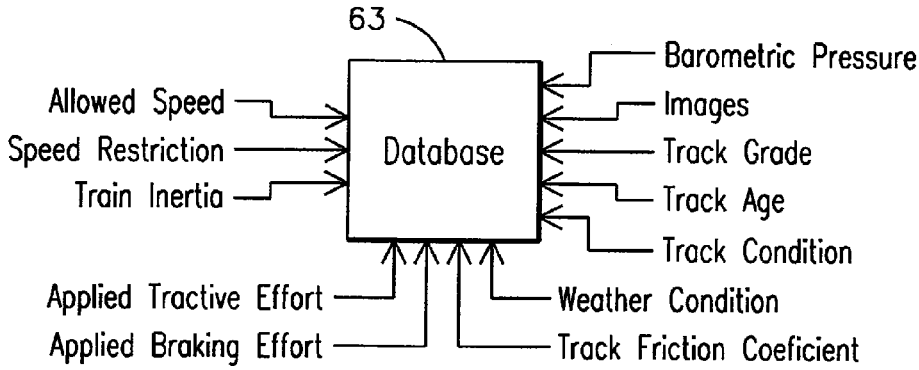
FIG. 11 depicts track database characteristics.

FIG. 11 illustrates track characterization information that can be provided while a train traverses the track segment. With the additional information provided, the trip optimizer can more accurately depict the conditions the train will encounter over the track segment of interest and thereby produce a more realistic and efficient optimized speed trajectory.

When track data base 63 is updated according to the various methods described herein, the new data can be used for planning future trips over the track segment of interest and/or re-planning the current trip. A re-plan of the current trip may be especially important if there is a large discrepancy between one or more values used to initially plan the trip and a later determined value of that parameter.

Figure 12:
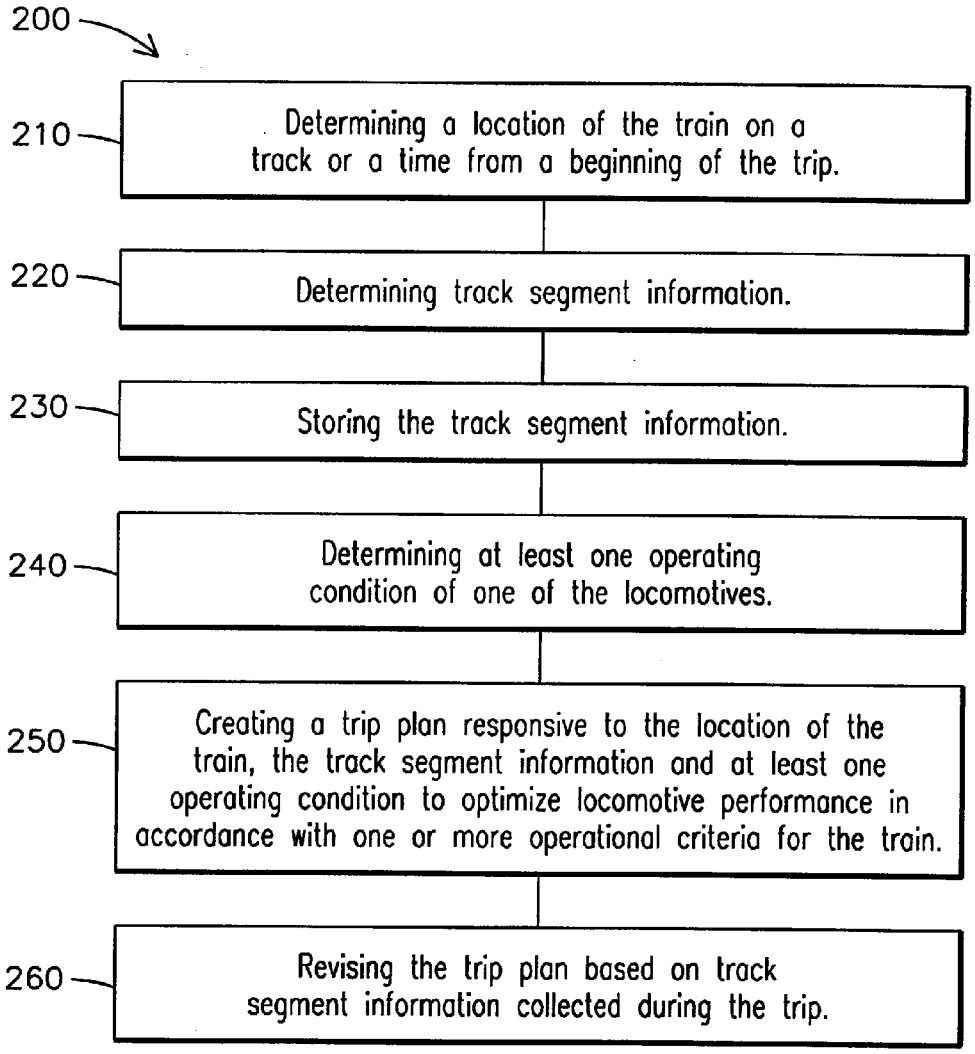
FIG. 12 illustrates a flow chart of exemplary steps for operating a train during a trip along a track segment.

FIG. 12 illustrates a flow chart of exemplary steps for operating a train during a trip along a track segment. The flow chart 200 includes determining track segment information, step 210. A determination is made about a location of the train on a track or a time from a beginning of the trip, step 220. The track segment information is stored, step 230. At least one operating condition of at least one of the locomotives is determined, step 240. A trip plan is created that is responsive to the location of the train, the track segment information, at least one operating condition to optimize locomotive performance in accordance with one or more operational criteria for the train, step 250. The trip optimization system and/or method discussed above may be used in creating the trip plan. The trip plan may be revised based on track segment information and/or train information collected during the trip, step 260. As discussed above, this flow chart may be implemented using a computer software code.

While the invention has been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A method comprising:

creating a first trip plan for a trip of a first rail vehicle along a track using first track segment information stored in a database, the first track segment information representative of one or more physical characteristics of the track to be traveled along during the trip, the first trip plan designating operational settings of the first rail vehicle in accordance with one or more operational criteria for the first rail vehicle in order to reduce at least one of emissions generated or fuel consumed by the first rail vehicle as the first rail vehicle travels along the track for the trip, wherein the operational settings of the first trip plan include at least one of designated throttle settings, designated brake settings, or designated power settings for the first rail vehicle that are expressed as a function of at least one of time or distance along the track;

monitoring actual operating conditions of the first rail vehicle as the first rail vehicle moves along the track according to the first trip plan, wherein the actual operating conditions of the first rail vehicle include at least one of actual throttle settings, actual brake settings, or actual power settings of the first rail vehicle;

using one or more processors, identifying a mismatch between the actual operating conditions of the first rail vehicle at one or more locations along the track and one or more expected operating conditions of the first rail vehicle at the one or more locations, the one or more expected operating conditions determined from the first track segment information used to create the first trip plan;

modifying the first track segment information stored in the database to updated track segment information responsive to the mismatch being identified, wherein the first track segment information is modified with information about the mismatch; and creating one or more additional trip plans for at least one of the first rail vehicle or an additional rail vehicle to travel along the track using the updated track segment information.

2. The method of claim 1, wherein the first and one or more additional trip plans are created and revised using the one or more processors that are disposed onboard the first rail vehicle.

3. The method of claim 1, wherein the database that stores the first track segment information and the updated track segment information is disposed off-board the first rail vehicle and the one or more additional rail vehicles.

4. The method of claim 1, wherein the operational settings of the first and one or more additional trip plans include speeds for the first rail vehicle or the one or more additional rail vehicles expressed as a function of at least one of time or distance along the track.

5. The method of claim 1, wherein the actual operating conditions of the first rail vehicle include at least one of actual speeds or accelerations of the first rail vehicle.

6. A method comprising:

generating a first trip plan for a trip of a first vehicle to travel along a route using one or more processors, the first trip plan designating operational settings of the first vehicle expressed as a function of at least one of time or distance along the route, the first trip plan generated using one or more physical characteristics of the route stored in and obtained from a database, wherein the operational settings of the first trip plan include at least one of designated throttle settings, designated brake settings, or designated power settings for the first vehicle that are expressed as a function of at least one of time or distance along the route;

comparing actual operating conditions of the first vehicle at one or more locations along the route with expected operating conditions of the first vehicle at the corresponding one or more locations to identify a mismatch between the actual operating conditions and the expected operating conditions using the one or more processors, the expected operating conditions determined from the one or more physical characteristics of the route that are used to generate the first trip plan, wherein the actual operating conditions of the first vehicle include at least one of actual throttle settings, actual brake settings, or actual power settings of the first vehicle; and revising at least one of the physical characteristics of the route that is stored in the database responsive to the mismatch that is identified using the one or more processors, wherein the at least one of the physical characteristics of the route are revised using information about the mismatch, wherein the at least one of the physical characteristics of the route is available for use to create one or more additional trip plans for at least one of the first vehicle or one or more additional vehicles.

7. The method of claim 6, wherein the database that stores the one or more physical characteristics of the route is disposed off-board of the first vehicle and the one or more additional vehicles.

8. The method of claim 6, wherein the one or more physical characteristics of the route that are used to generate the first trip plan and that are revised responsive to the mismatch being identified include altitude information of the route.

9. The method of claim 6, wherein the one or more physical characteristics of the route that are used to generate the first trip plan and that are revised responsive to the mismatch being identified include grade information of the route.

10. The method of claim 9, wherein the mismatch is identified by comparing an actual rate of change in speed of the first vehicle at a location along the route with an expected rate of change in the speed of the first vehicle at the location along the route, the expected rate of change in the speed calculated from the grade information of the route at the location.

11. The method of claim 9, wherein the mismatch is identified by comparing an actual inertia of the first vehicle at a location along the route with an expected inertia of the first vehicle at the location along the route, the expected inertia calculated from the grade information of the route at the location.

12. The method of claim 6, further comprising confirming the mismatch between the actual operating conditions and the expected operating conditions with additional operating conditions of one or more other vehicles traveling along the route according to one or more respective additional trip plans.

13. The method of claim 6, wherein the first vehicle is a rail vehicle and the route is a track.

* * * * *